US012196422B2

(12) United States Patent
Singh et al.

(10) Patent No.: US 12,196,422 B2
(45) Date of Patent: Jan. 14, 2025

(54) COMBUSTOR WITH SECONDARY FUEL NOZZLE IN DILUTION FENCE

(71) Applicant: General Electric Company, Schenectady, NY (US)

(72) Inventors: Saket Singh, Bengaluru (IN); Rimple Rangrej, Bengaluru (IN); Pradeep Naik, Bengaluru (IN); Michael A. Benjamin, Cincinnati, OH (US); Joseph Zelina, Waynesville, OH (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 17/664,971

(22) Filed: May 25, 2022

(65) Prior Publication Data

US 2023/0408098 A1 Dec. 21, 2023

(51) Int. Cl.
*F23R 3/34* (2006.01)
*F23R 3/06* (2006.01)

(52) U.S. Cl.
CPC ..... *F23R 3/346* (2013.01); *F23R 3/06* (2013.01)

(58) Field of Classification Search
CPC .... F23R 3/34; F23R 3/346; F23R 3/06; F23C 6/047
See application file for complete search history.

(56) References Cited

U.S. PATENT DOCUMENTS

| | | | | |
|---|---|---|---|---|
| 3,872,664 | A * | 3/1975 | Lohmann | F23R 3/346 431/9 |
| 3,934,409 | A * | 1/1976 | Quillevere | F23R 3/34 60/749 |
| 5,012,640 | A | 5/1991 | Mirville | |
| 5,121,597 | A | 6/1992 | Urushidani et al. | |
| 5,375,420 | A * | 12/1994 | Falls | F23R 3/50 60/752 |
| 5,628,192 | A | 5/1997 | Hayes-Bradley et al. | |
| 5,749,219 | A * | 5/1998 | DuBell | F23R 3/346 60/737 |
| 9,068,748 | B2 | 6/2015 | Hoke | |
| 9,797,601 | B2 | 10/2017 | Cheung et al. | |
| 10,060,629 | B2 | 8/2018 | Kim et al. | |
| 10,060,630 | B2 | 8/2018 | Stuttaford et al. | |
| 10,739,003 | B2 | 8/2020 | Proscia | |
| 11,143,407 | B2 | 10/2021 | Hoke et al. | |
| 2016/0146464 | A1 | 5/2016 | Pasqualotto et al. | |
| 2016/0146467 | A1 | 5/2016 | Eroglu | |
| 2016/0245523 | A1 * | 8/2016 | Kim | F23R 3/346 |
| 2019/0162414 | A1 | 5/2019 | Ogata et al. | |

FOREIGN PATENT DOCUMENTS

EP 3317586 B1 11/2020

* cited by examiner

*Primary Examiner* — Andrew H Nguyen
(74) *Attorney, Agent, or Firm* — Venable LLP; Griffin A. A. Deadwick; Michele V. Frank

(57) ABSTRACT

A combustor for a gas turbine includes a combustor liner having an outer liner and an inner liner defining a combustion chamber therebetween. At least one of the outer liner and the inner liner includes a dilution fence arranged in a dilution zone of the combustion chamber. The dilution fence extends into the combustion chamber and has at least one secondary fuel nozzle opening therethrough, and at least one secondary fuel nozzle is arranged through the at least one secondary fuel nozzle opening.

20 Claims, 9 Drawing Sheets

COMBUSTOR WITH SECONDARY FUEL NOZZLE IN DILUTION FENCE

TECHNICAL FIELD

The present disclosure relates to dilution of combustion gases in a combustion chamber of a gas turbine engine.

BACKGROUND

Conventional gas turbine engines provide a flow of dilution air into a combustion chamber downstream of a primary combustion zone. Conventionally, an annular combustor liner may include both an inner liner and an outer liner forming a combustion chamber between them. The inner liner and the outer liner may include dilution holes through the liners that provide a flow of air (i.e., a dilution jet) from a passage surrounding the annular combustor liner into the combustion chamber. The flow of dilution air through the dilution holes mixes with combustion gases within the combustion chamber to provide quenching of the combustion gases.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

DETAILED DESCRIPTION

Various embodiments are discussed in detail below. While specific embodiments are discussed, this is done for illustration purposes only. A person skilled in the relevant art will recognize that other components and configurations may be used without departing from the spirit and the scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

In a combustion section of a turbine engine, air flows through an outer passage surrounding a combustor liner, and through an inner passage surrounding the combustor liner. Some of the airflow in both the outer passage and the inner passage is diverted through the combustor liner to provide quenching of combustion gases within the combustion chamber. However, quenching of the product of combustion from the primary zone must be done quickly and efficiently so that regions of high temperature can be minimized, and thereby $NO_x$ emissions from the combustion system can be reduced.

The present disclosure aims to reduce the $NO_x$ emissions by providing dilution air flow and staging of secondary fuel within the combustion chamber through a dilution fence. According to the present disclosure, a combustor liner that includes an outer liner and an inner may include an outer liner dilution fence and an inner liner dilution fence arranged in a dilution zone of the combustion chamber. Each of the outer liner dilution fence and the inner liner dilution fence provides a flow of dilution air therethrough to provide the quenching of the combustion gases, and mixing of the dilution air with the combustion gases in a manner that reduces nitrous-oxide ($NO_x$) emissions. In addition, the outer liner dilution fence may include at least one secondary fuel nozzle opening therethrough that has a corresponding secondary fuel nozzle arranged through the secondary fuel nozzle opening. With this arrangement, secondary fuel can be staged at the dilution zone to mix with the dilution air and with the combustion gases to achieve better $NO_x$ emissions.

Figure 1:
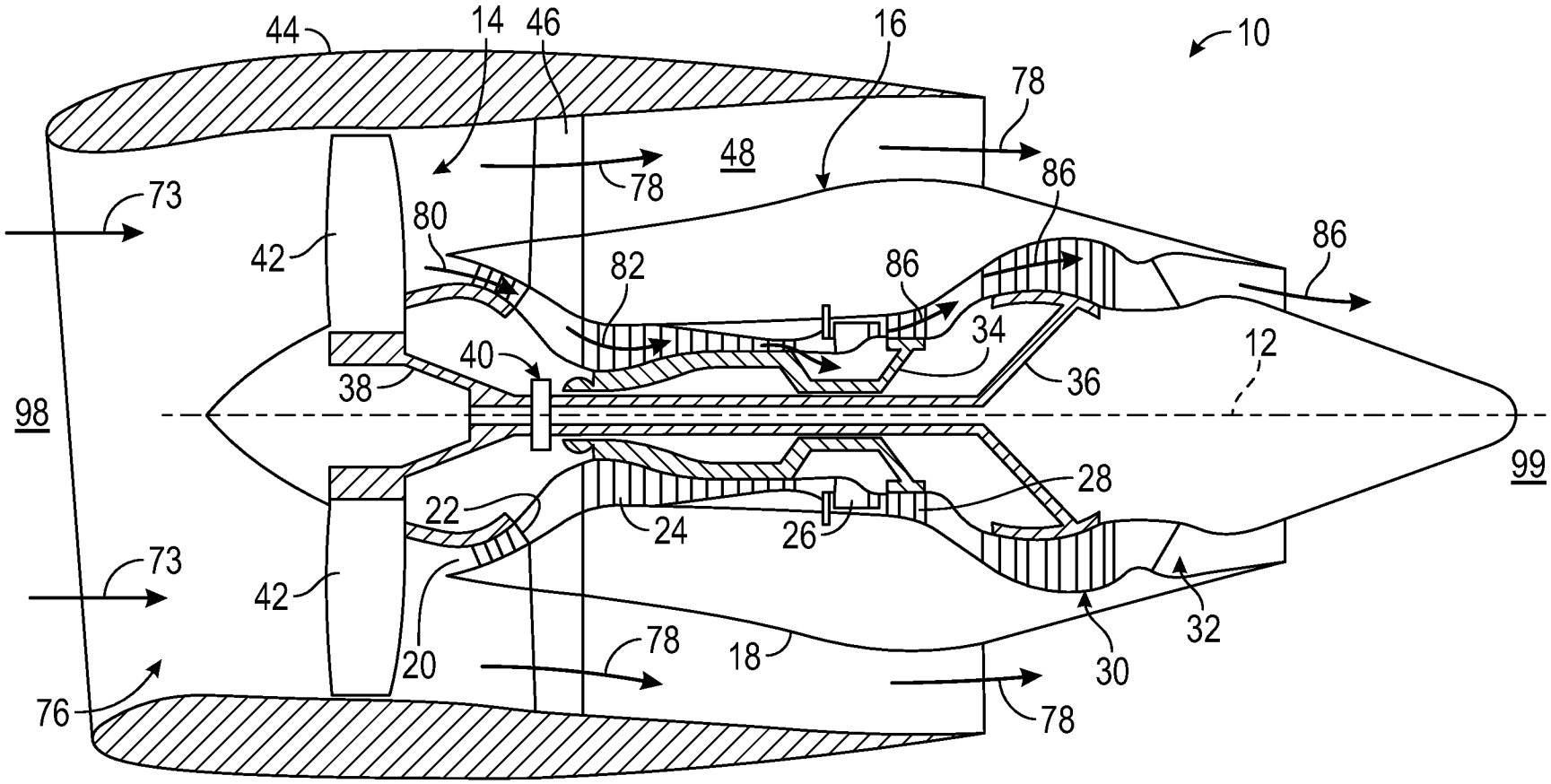
FIG. 1 is a schematic partially cross-sectional side view of an exemplary high by-pass turbofan jet engine, according to an aspect of the present disclosure.

Referring now to the drawings, FIG. 1 is a schematic partially cross-sectional side view of an exemplary high by-pass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, engine 10 has an engine centerline axis 12 that extends therethrough from an upstream end 98 of the engine 10 to a downstream end 99 of the engine 10 for reference purposes. In general, engine 10 may include a fan assembly 14 and a core engine 16 disposed downstream from the fan assembly 14.

The core engine 16 may generally include an outer casing 18 that defines an annular inlet 20. The outer casing 18 encases or at least partially forms, in serial flow relationship, a compressor section (22/24) having a low pressure (LP) compressor 22 and a high pressure (HP) compressor 24, a combustor 26, a turbine section (28/30) including a high pressure (HP) turbine 28 and a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a gear system 40, such as in an indirect-drive configuration or a geared-drive configuration.

As shown in FIG. 1, the fan assembly 14 includes a plurality of fan blades 42 that are coupled to and that extend radially outwardly from the fan shaft 38. An annular fan casing, or a nacelle 44, circumferentially surrounds the fan assembly 14 and/or at least a portion of the core engine 16. In one embodiment, the nacelle 44 may be supported relative to the core engine 16 by a plurality of circumferentially spaced outlet guide vanes or struts 46. Moreover, at least a portion of the nacelle 44 may extend over an outer portion of the core engine 16, so as to define a bypass airflow passage 48 therebetween.

Figure 2:
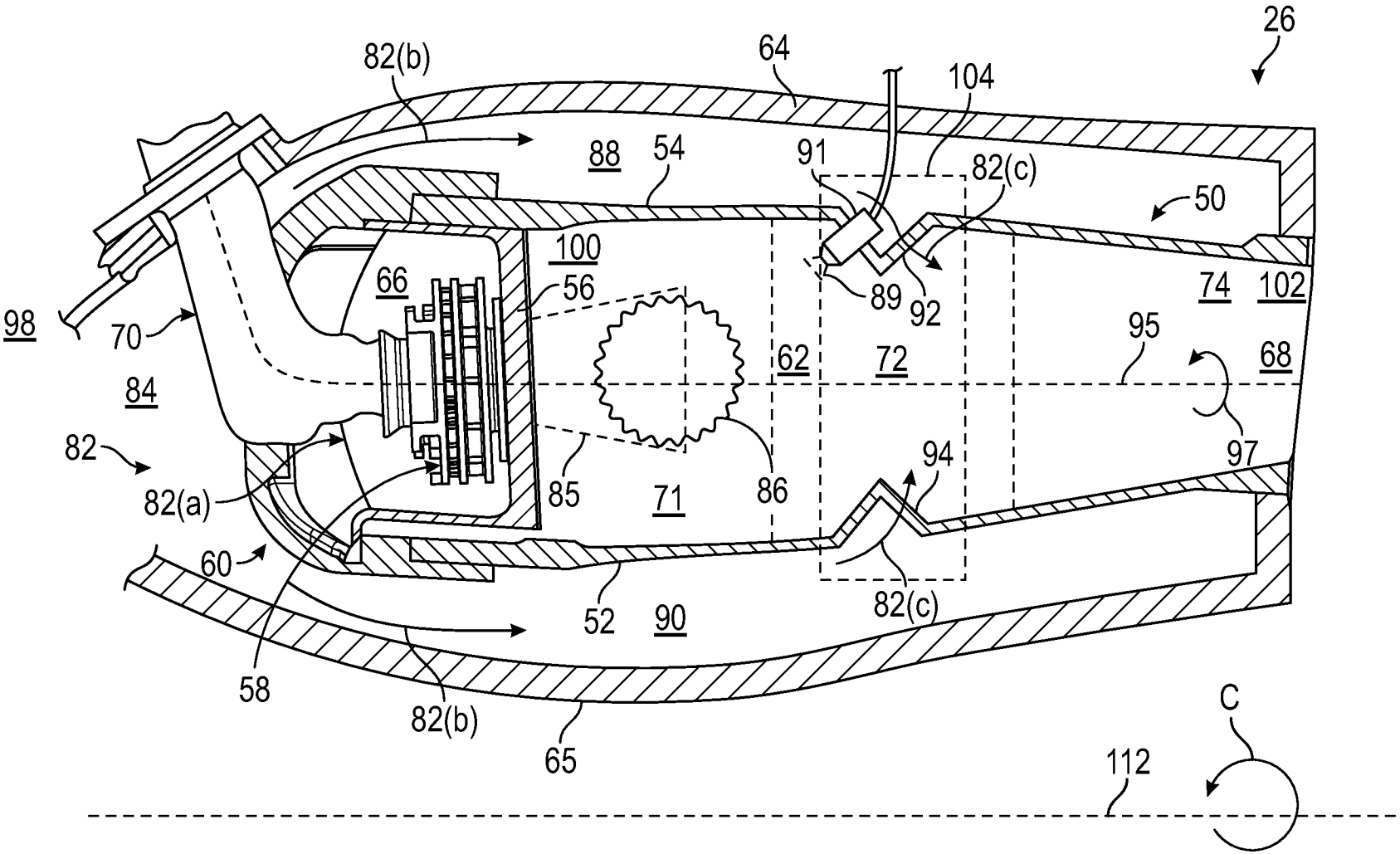
FIG. 2 is a partial cross-sectional side view of an exemplary combustor, according to an aspect of the present disclosure.

FIG. 2 is a cross-sectional side view of an exemplary combustor 26 of the core engine 16 as shown in FIG. 1. As shown in FIG. 2, the combustor 26 may generally define a combustor centerline axis 112, that may correspond to the engine centerline axis 12, and, while FIG. 2 depicts a cross-sectional view, the combustor 26 extends circumferentially about the combustor centerline axis 112. The combustor 26 includes a combustor liner 50 having an inner liner 52 and an outer liner 54, a cowl 60, and a dome assembly 56. The outer liner 54 and the inner liner 52 extend circumferentially about the combustor centerline axis 112. The dome assembly 56 extends radially between the outer liner 54 and the inner liner 52 and also extends circumferentially about the combustor centerline axis 112. Together, the inner liner 52, the outer liner 54, and the dome assembly 56 define a combustion chamber 62 that extends circumferentially about the combustor centerline axis 112, and that extends from an upstream end 100 to a downstream end 102. The combustion chamber 62 may more specifically define various regions, including a primary combustion zone 71 at which an initial chemical reaction of a swirled fuel/oxidizer mixture 85 and/or recirculation of combustion gases 86 may occur before flowing further downstream to a dilution zone 72 and then to a secondary combustion zone 74. In the dilution zone 72, as will be described in more detail below, the combustion gases 86 may be mixed with compressed air 82(*c*) that flows through an outer liner dilution fence 92 of the outer liner 54 and through an inner liner dilution fence 94 of the inner liner 52 into the dilution zone 72 of the combustion chamber 62. The combustion gases 86 may also be mixed with a secondary fuel 89 injected into the combustion chamber 62 from at least one secondary fuel nozzle 91 that extends through the outer liner dilution fence 92 before flowing through a turbine inlet 68 to the HP turbine 28 and the LP turbine 30 (FIG. 1). The secondary fuel nozzle 91 may be a spray-type fuel nozzle that injects a spray of fuel into the combustion chamber 62, or may be a jet-type fuel nozzle that injects a jet stream of fuel into the combustion chamber 62. Alternatively, the secondary fuel nozzle 91 may be a pressure-swirl type fuel nozzle that provides a pressurized swirled flow of the fuel into the combustion chamber 62, or may be a pure air-blast type fuel nozzle, or any other type of fuel nozzle.

As shown in FIG. 2, the inner liner 52 may be encased within an inner casing 65 and the outer liner 54 may be encased within an outer casing 64. An outer flow passage 88 is defined between the outer casing 64 and the outer liner 54, and an inner flow passage 90 is defined between the inner casing 65 and the inner liner 52. As will be described in more detail below, the outer liner 54 may include the outer liner dilution fence 92, and the inner liner 52 may include the inner liner dilution fence 94. Both the outer liner dilution fence 92 and the inner liner dilution fence 94 may extend circumferentially about the combustor centerline axis 112, or may comprise a plurality of circumferentially spaced apart fence sections. Various aspects of the outer liner dilution fence 92 with the secondary fuel nozzle 91, and the inner liner dilution fence 94, as well as a relationship between them within the combustor 26, will be described in more detail below. Generally, the outer liner dilution fence 92 and the inner liner dilution fence 94 provide a flow of compressed air 82(*c*) therethrough and into the dilution zone 72 of the combustion chamber 62. The flow of compressed air 82(*c*) can thus be utilized to provide quenching of the combustion gases 86 in the dilution zone 72 so as to cool the flow of combustion gases 86 entering the turbine section (28/30).

In the cross-sectional view of FIG. 2, the combustor 26 is seen to include a main mixer assembly 58 and a fuel nozzle assembly 70 connected with the main mixer assembly 58. While the cross-sectional view of FIG. 2 depicts a single main mixer assembly 58, the combustor 26 includes a plurality of main mixer assemblies 58 connected to the dome assembly 56, with the plurality of main mixer assemblies 58 being circumferentially spaced about the combustor centerline axis 112. Similarly, a plurality of the fuel nozzle assemblies 70 are provided for respective ones of the plurality of main mixer assemblies 58.

During operation of the engine 10, as shown in FIGS. 1 and 2 collectively, a volume of air 73, as indicated schematically by arrows, enters the engine 10 from the upstream end 98 of the engine 10 through an associated inlet 76 of the nacelle 44 and/or the fan assembly 14. As the volume of air 73 passes across the fan blades 42, a portion of the air 73, as indicated schematically by arrows 78, is directed or routed into the bypass airflow passage 48, while another portion of the air 80, as indicated schematically by an arrow, is directed or routed into the annular inlet 20 and into the LP compressor 22. The air 80 is progressively compressed to form compressed air 82 as it flows through the LP compressor 22 and the HP compressor 24 towards the combustor 26.

Referring to FIG. 2, the compressed air 82, as indicated schematically by an arrow, flows into a diffuser cavity 84 of the combustor 26 and pressurizes the diffuser cavity 84. A first portion of the compressed air 82(*a*), as indicated schematically by arrows, flows from the diffuser cavity 84 into a pressure plenum 66 within the cowl 60, where it is then swirled and mixed with fuel provided from the fuel nozzle assembly 70, by the main mixer assembly 58 to generate the swirled fuel/oxidizer mixture 85 that is then ignited and burned to generate the combustion gases 86. The swirled fuel/oxidizer mixture 85 may be swirled about a mixer centerline 95 in a main mixer swirl direction 97 that may be either in a clockwise direction about the mixer centerline 95, or may be in a counterclockwise direction about the mixer centerline 95. A second portion of the compressed air 82(*b*) may be routed from the diffuser cavity 84 and used for various purposes other than combustion. For example, as shown in FIG. 2, the compressed air 82(*b*) may be routed into the outer flow passage 88 and into the inner flow passage 90. A portion of the compressed air 82(*b*) may then be routed from the outer flow passage 88 through the outer liner dilution fence 92 (schematically shown with an arrow as compressed air 82(*c*)) and into the dilution zone 72 of combustion chamber 62 to provide quenching of the combustion gases 86 in dilution zone 72. The compressed air 82(*c*) may also provide turbulence to the flow of the combustion gases 86 so as to provide for better mixing of the compressed air 82(*c*) with the combustion gases 86. A similar flow of the compressed air 82(*c*) from the inner flow passage 90 flows through the inner liner dilution fence 94 of the inner liner 52. In addition, or in the alternative, at least a portion of compressed air 82(*b*) may be routed out of the diffuser cavity 84 through various flow passages to other portions of the engine 10 to provide cooling air to at least one of the HP turbine 28 or the LP turbine 30.

Referring back to FIGS. 1 and 2 collectively, the combustion gases 86 generated in the combustion chamber 62 flow from the combustor 26 into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsion at downstream end 99.

Figure 3:
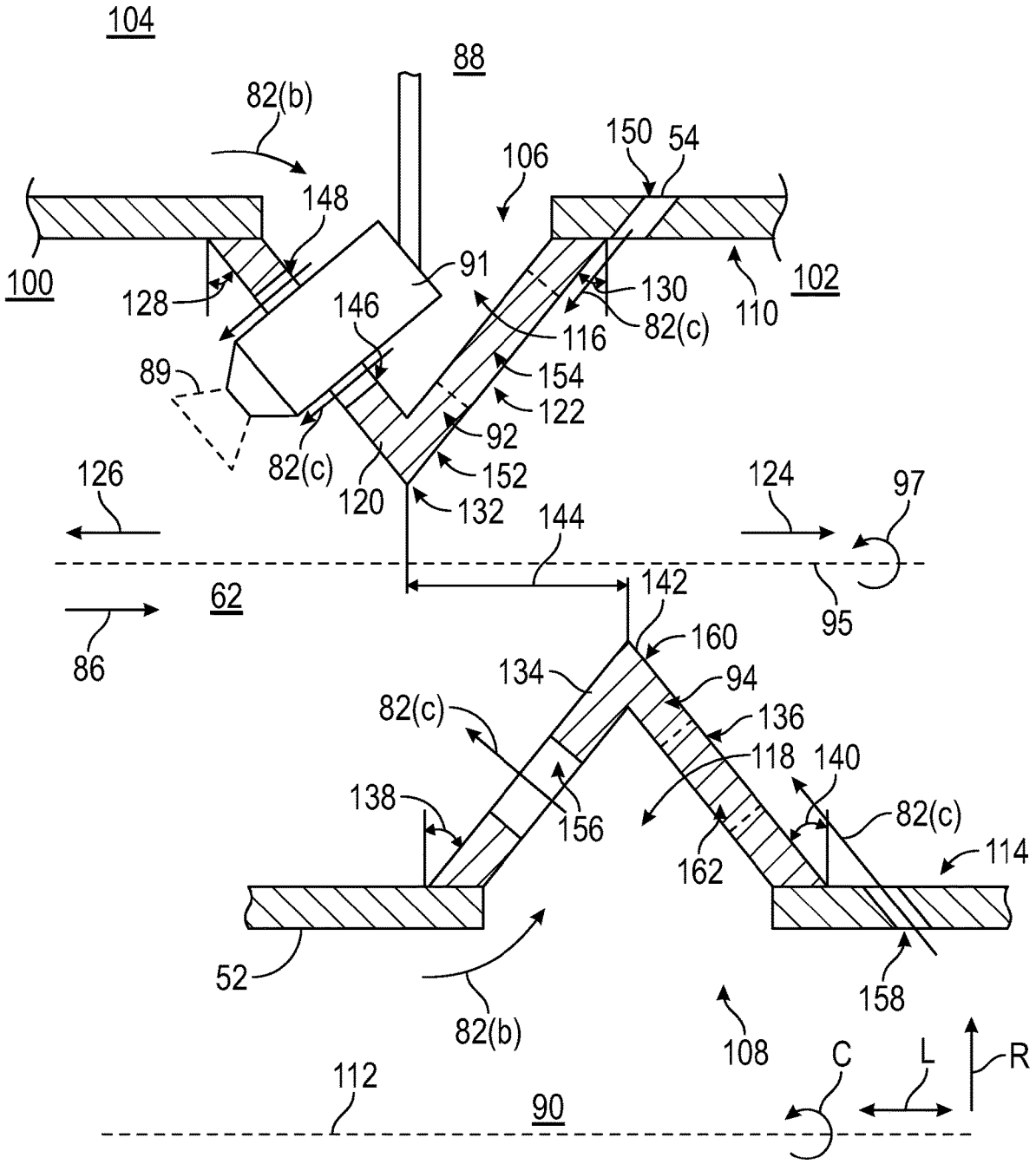
FIG. 3 is a partial cross-sectional side view, taken at detail view 104 of FIG. 2, of a portion of an outer liner and an inner liner at a dilution zone, according to an aspect of the present disclosure.

FIG. 3 is a partial cross-sectional view of a portion of the outer liner 54 and the inner liner 52 at the dilution zone 72 (FIG. 2) depicting an aspect of the outer liner dilution fence 92 and inner liner dilution fence 94 taken at detail view 104 of FIG. 2. In the FIG. 3 aspect, the outer liner dilution fence 92 and the inner liner dilution fence 94 are generally shown as having a V-shaped side view. The outer liner 54 includes an outer liner slotted dilution opening 106 through the outer liner 54, and the inner liner 52 includes an inner liner slotted dilution opening 108 through the inner liner 52. Both the outer liner slotted dilution opening 106 and the inner liner slotted dilution opening 108 extend in the circumferential direction (C) with respect to the combustor centerline axis 112 and may extend circumferentially about the combustor centerline axis 112. The outer liner dilution fence 92 extends into the combustion chamber 62 from a hot surface side 110 of the outer liner 54, and the inner liner dilution fence 94 extends into the combustion chamber 62 from a hot surface side 114 of the inner liner 52. The outer liner dilution fence 92 spans across the outer liner slotted dilution opening 106, and the inner liner dilution fence 94 spans across the inner liner slotted dilution opening 108. Thus, the compressed air 82(*b*) from the outer flow passage 88 can flow into an outer liner dilution fence cavity 116 of the outer liner dilution fence 92, and a flow of the compressed air 82(*b*) from the inner flow passage 90 can flow into an inner liner dilution fence cavity 118 of the inner liner dilution fence 94.

The outer liner dilution fence 92 includes an outer liner dilution fence upstream portion 120 and an outer liner dilution fence downstream portion 122. The outer liner dilution fence upstream portion 120 may extend from the hot surface side 110 of the outer liner 54 in a downstream direction 124 at a downstream angle 128, and the outer liner dilution fence downstream portion 122 may extend from the hot surface side 110 in an upstream direction 126 at an upstream angle 130. The outer liner dilution fence upstream portion 120 and the outer liner dilution fence downstream portion 122 may be joined together at an outer liner dilution fence inner end 132 so as to form the generally V-shape of the outer liner dilution fence 92. Similarly, the inner liner dilution fence 94 includes an inner liner dilution fence upstream portion 134 and an inner liner dilution fence downstream portion 136. The inner liner dilution fence upstream portion 134 may extend from the hot surface side 114 of the inner liner 52 in the downstream direction 124 at a downstream angle 138, and the inner liner dilution fence downstream portion 136 may extend from the hot surface side 114 in the upstream direction 126 at an upstream angle 140. The inner liner dilution fence upstream portion 134 and the inner liner dilution fence downstream portion 136 may be joined together at an inner liner dilution fence inner end 142 so as to form the generally V-shape of the inner liner dilution fence 94. As shown in FIG. 3, the outer liner dilution fence 92 and the inner liner dilution fence 94 may be offset in the longitudinal direction (L) along the mixer centerline 95 by an offset distance 144. The offset distance 144 may be taken with respect to the outer liner dilution fence inner end 132 and the inner liner dilution fence inner end 142. In some aspects, the offset distance 144 may be zero, such that the outer liner dilution fence 92 and the inner liner dilution fence 94 are arranged opposing one another across the combustion chamber 62.

The outer liner dilution fence 92 includes at least one secondary fuel nozzle opening 146 therethrough, and, in the FIG. 3 aspect, at least one secondary fuel nozzle opening 146 is provided through the outer liner dilution fence upstream portion 120. At least one secondary fuel nozzle 91 is arranged through the secondary fuel nozzle opening 146, and is arranged to provide a flow of the secondary fuel 89 in the upstream direction 126 so as to oppose the flow of the combustion gases 86 flowing in the downstream direction 124. While the FIG. 3 aspect depicts the secondary fuel nozzle 91 being arranged through the outer liner dilution fence 92, the secondary fuel nozzle 91 may be arranged through the inner liner dilution fence 94 instead. In addition, while the cross-sectional view of FIG. 3 depicts one secondary fuel nozzle opening 146 and one secondary fuel nozzle 91, a plurality of the secondary fuel nozzle openings 146 and a corresponding plurality of the secondary fuel nozzles 91 may be implemented in the outer liner dilution fence 92. As one example, the outer liner dilution fence 92 may include four secondary fuel nozzle openings 146 that are circumferentially spaced apart about the outer liner dilution fence 92, with a corresponding four second fuel nozzles 91 being arranged through the respective four secondary fuel nozzle openings 146. In some aspects, the number of secondary fuel nozzle openings 146 and corresponding secondary fuel nozzles 91 may correspond to the number of main mixer assemblies 58, while, in other aspects, the number of secondary fuel nozzle openings 146 and the number of secondary fuel nozzles 91 may be fewer than the number of main mixer assemblies 58.

In the FIG. 3 aspect, the outer liner secondary fuel nozzle opening 146 may larger than the secondary fuel nozzle 91 so as to provide a gap 148 between the secondary fuel nozzle opening 146 and the secondary fuel nozzle 91 to allow a flow of dilution air 82(*c*) through the gap 148 around an outer periphery of the secondary fuel nozzle 91. The flow of dilution air 82(*c*) through the gap 148 may assist in directing the flow of the secondary fuel 89 from the secondary fuel nozzle 91 away from the outer liner dilution fence 92 so as to reduce the possibility of the secondary fuel 89 wetting the outer liner dilution fence 92. In the FIG. 3 aspect, at least one outer liner dilution opening 150 is provided through the outer liner 54. The at least one outer liner dilution opening 150 may be a plurality of openings circumferentially spaced apart about the outer liner 54, or may be a circumferential slotted opening extending about the circumference of the outer liner 54. The outer liner dilution opening 150 may be provided downstream of the outer liner dilution fence downstream portion 122 and may be angled through the outer liner 54 at the upstream angle 130. In this manner, the outer liner dilution opening 150 provides a flow of dilution air 82(*c*) along a downstream side 152 of the outer liner dilution fence downstream portion 122 and can assist in reducing the possibility of the secondary fuel 89 wetting the outer liner dilution fence inner end 132 of the outer liner dilution fence 92. In an alternative arrangement, the outer liner dilution fence downstream portion 122 may include an outer liner dilution fence downstream portion dilution opening 154 (shown with hidden lines in FIG. 3) to allow a flow of dilution air 82(*c*) to flow therethrough rather than including the outer liner dilution opening 150.

The inner liner dilution fence upstream portion 134 includes at least one inner liner dilution fence upstream portion dilution opening 156 therethrough to provide a flow of the dilution air 82(*c*) to flow into the combustion chamber 62. The inner liner dilution fence upstream portion dilution opening 156 may be a plurality of circumferentially spaced openings, or may be an annular slot opening extending circumferentially about the combustor centerline axis 112. In the FIG. 3 aspect, similar to the outer liner 54, the inner liner 52 includes at least one inner liner dilution opening 158 therethrough arranged downstream of the inner liner dilution fence downstream portion 136 and arranged to provide a flow of the dilution air 82(*c*) along a downstream side 160 of the inner liner dilution fence downstream portion 136. Similar to the outer liner dilution opening 150, the inner liner dilution opening 158 may be a plurality of openings circumferentially spaced apart about the inner liner 52, or may be a circumferential slotted opening extending about the circumference of the inner liner 52. The inner liner dilution opening 158 may be angled through the inner liner 52 at the upstream angle 140. In an alternative arrangement, the inner liner dilution fence downstream portion 136 may include an inner liner dilution fence downstream portion dilution opening 162 (shown with hidden lines) therethrough rather than including the inner liner dilution opening 158.

Figure 4:
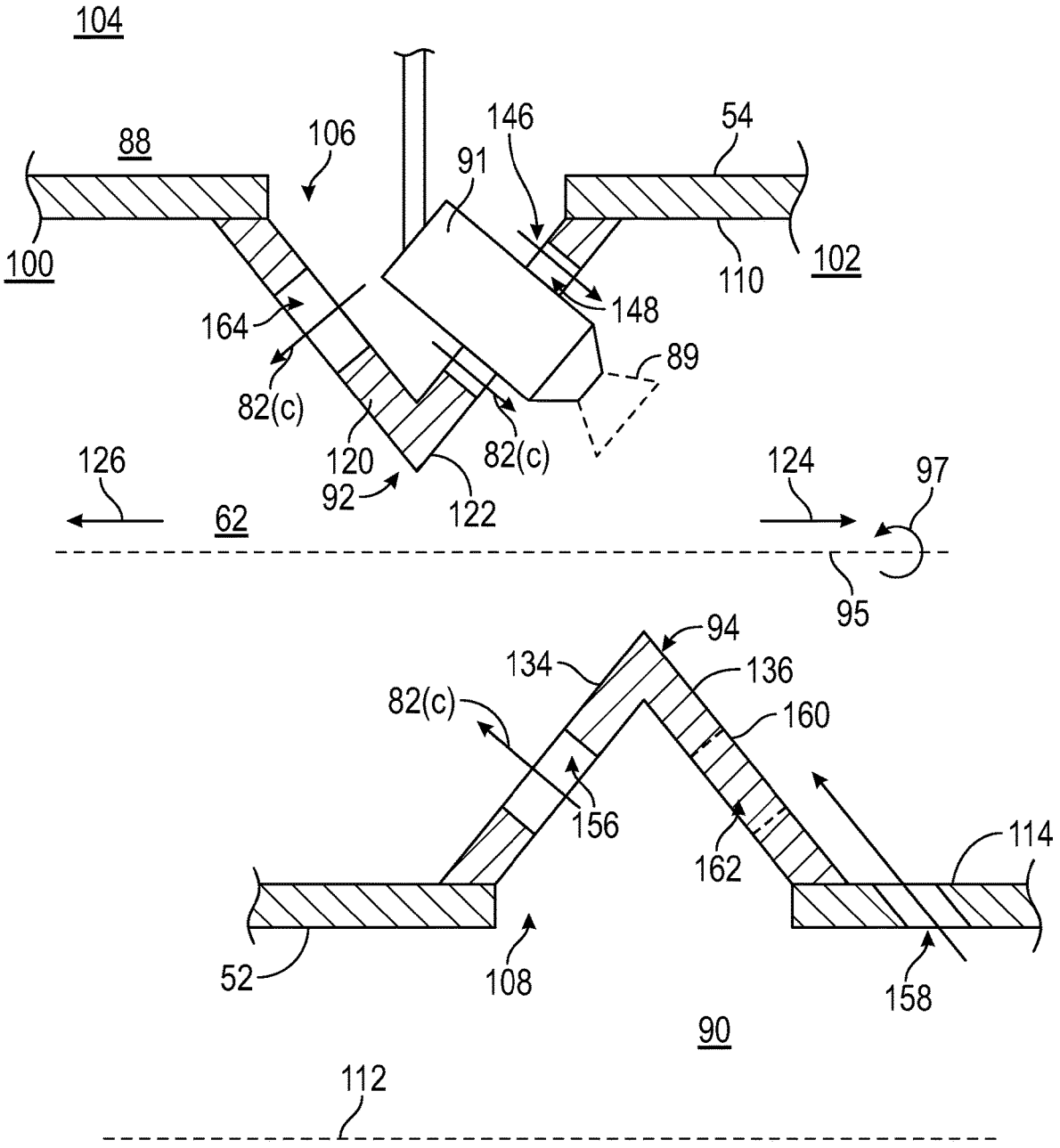
FIG. 4 is a partial cross-sectional side view of an alternate outer liner and an inner liner portion at a dilution zone, according to an aspect of the present disclosure.

FIG. 4 is a partial cross-sectional view of a portion of the outer liner 54 and the inner liner 52 at the dilution zone 72 depicting an alternate aspect of the outer liner dilution fence 92 and inner liner dilution fence 94. The FIG. 4 aspect is similar to the FIG. 3 aspect and like reference numerals will not be described again. In particular, the inner liner dilution fence 94 of the FIG. 4 aspect may be the same as the inner liner dilution fence 94 of the FIG. 3 aspect. In the FIG. 4 aspect, however, the at least one secondary fuel nozzle opening 146 and the at least one secondary fuel nozzle 91 are seen to be provided through the outer liner dilution fence downstream portion 122 rather than through the outer liner dilution fence upstream portion 120 as was shown in FIG. 3. Thus, the at least one secondary fuel nozzle 91 is arranged to provide the flow of the secondary fuel 89 into the combustion chamber 62 in the downstream direction 124 downstream of the outer liner dilution fence 92, and in the same direction as the flow of the combustion gases 86. In addition, the outer liner dilution fence upstream portion 120 of the outer liner dilution fence 92 is seen to include at least one outer liner dilution fence upstream portion dilution opening 164 therethrough that is arranged to provide a flow of the dilution air 82(*c*) into the combustion chamber 62 in the upstream direction 126.

Figure 5:
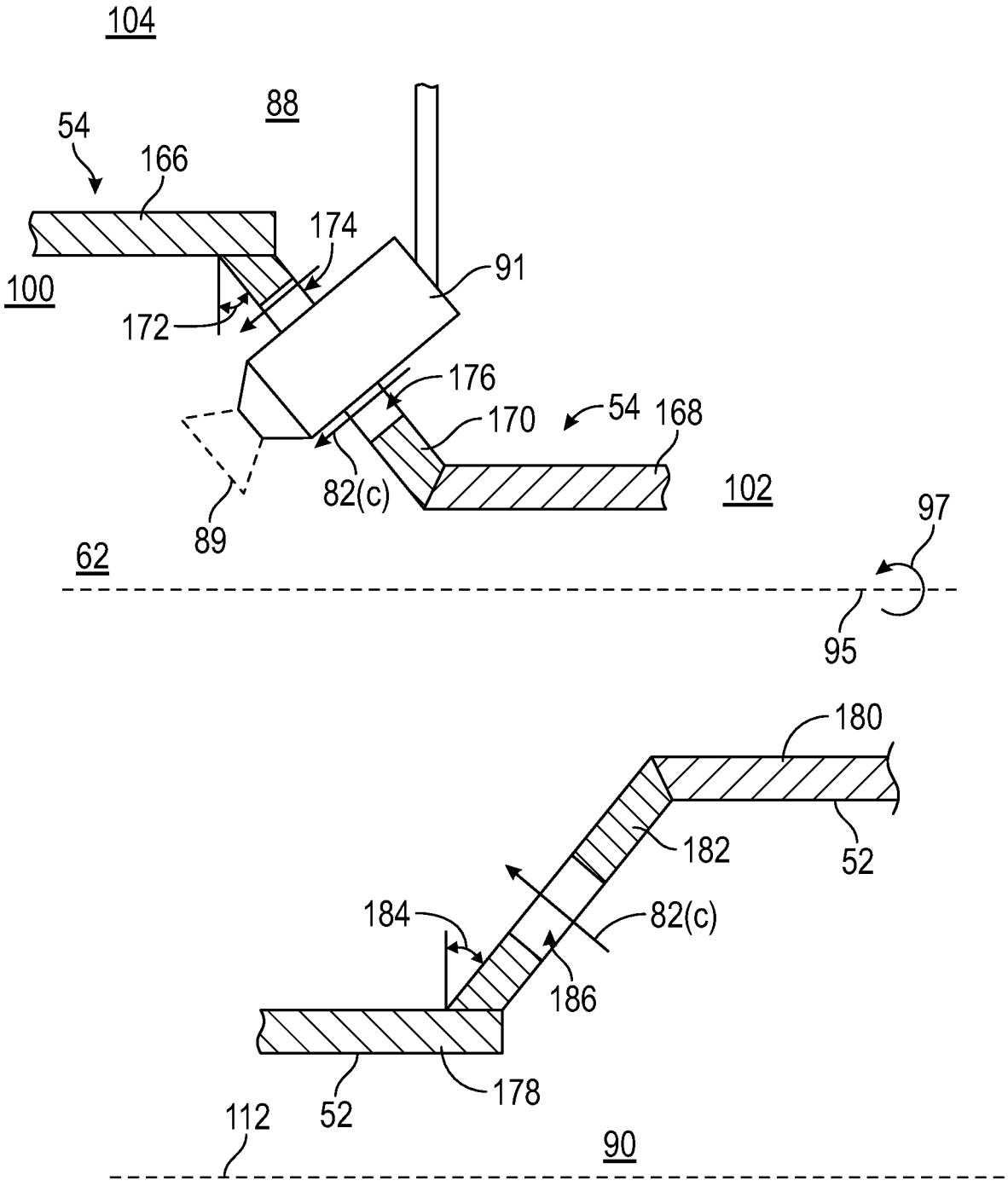
FIG. 5 is a partial cross-sectional side view of an alternate outer liner and an inner liner portion at a dilution zone, according to an aspect of the present disclosure.

FIG. 5 is a partial cross-sectional view of a portion of the outer liner 54 and the inner liner 52 at the dilution zone 72 depicting another alternate aspect of the present disclosure. In the FIG. 5 aspect, the outer liner 54 may include an outer liner upstream portion 166 and an outer liner downstream portion 168, with an outer liner dilution fence 170 extending inward from the outer liner upstream portion 166 into the combustion chamber 62 and connecting the outer liner upstream portion 166 and the outer liner downstream portion 168. The outer liner dilution fence 170 may be angled at a downstream angle 172, and may include at least one secondary fuel nozzle opening 174 therethrough. The secondary fuel nozzle opening 174 may be similar to the secondary fuel nozzle opening 146 (FIG. 3). When the secondary fuel nozzle 91 is arranged through the secondary fuel nozzle opening 174, a gap 176 may be present about a periphery of the secondary fuel nozzle 91 between the secondary fuel nozzle 91 and the secondary fuel nozzle opening 174 so as to provide a flow of the dilution air 82(*c*) to flow through the gap 176. Similarly, the inner liner 52 may include an inner liner upstream portion 178 and an inner liner downstream portion 180, with an inner liner dilution fence 182 extending outward from the inner liner upstream portion 178 into the combustion chamber 62 and connecting the inner liner upstream portion 178 and the inner liner downstream portion 180. The inner liner dilution fence 182 may be angled at a downstream angle 184, and may include at least inner liner dilution fence dilution opening 186 therethrough. The at least one inner liner dilution fence dilution opening 186 may be similar to the inner liner dilution fence upstream portion dilution opening 156 (FIGS. 3 and 4). Thus, the inner liner dilution fence dilution opening 186 provides for a flow of the dilution air 82(*c*) therethrough from the inner flow passage 90 into the combustion chamber 62.

Figure 6:
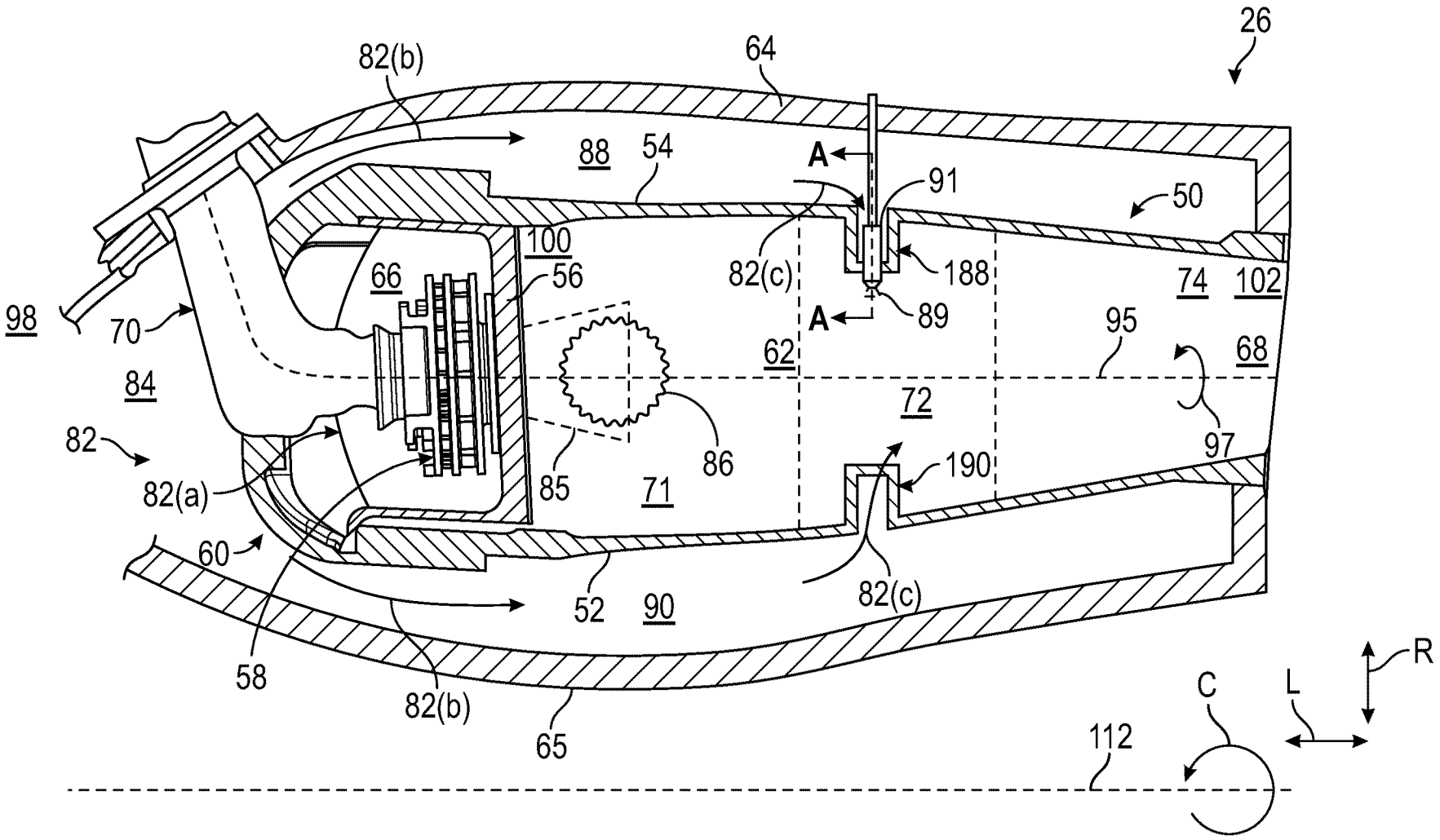
FIG. 6 is a partial cross-sectional side view of another exemplary combustor, according to another aspect of the present disclosure.

FIG. 6 is a cross-sectional side view of another exemplary combustor 26 of the core engine 16 as shown in FIG. 1, according to another aspect of the present disclosure. Generally, the FIG. 6 aspect of the combustor 26 is similar to the combustor 26 of the FIG. 2 aspect, except that, as will be described below, the outer liner dilution fence is arranged to provide a lateral flow of the dilution air 82(*c*) and, in some aspects, a lateral flow of the secondary fuel 89. In the FIG. 6 aspect, the outer liner 54 is seen to include an outer liner dilution fence 188, and the inner liner 52 is seen to include an inner liner dilution fence 190. Compared to the generally V-shaped outer liner dilution fence 92 of FIGS. 2 to 4, the outer liner dilution fence 188 of FIG. 6 is seen to have a generally U-shaped side cross section. Similarly, the inner liner dilution fence 190 is also seen to include a generally U-shaped dilution fence, although the inner liner dilution fence 94 of FIGS. 2 to 4 may also be included within the FIG. 6 aspect. The outer liner dilution fence 188 includes the at least one secondary fuel nozzle 91 therethrough, similar to the FIGS. 2 to 4 aspects. However, while the following aspects may be described with regard to the outer liner dilution fence 188, they may be equally applicable to the inner liner dilution fence 190 instead. In addition, in the following aspects, the secondary fuel nozzle 91 may be arranged to provide a lateral flow of the secondary fuel 89 into the combustion chamber 62.

Figure 7:
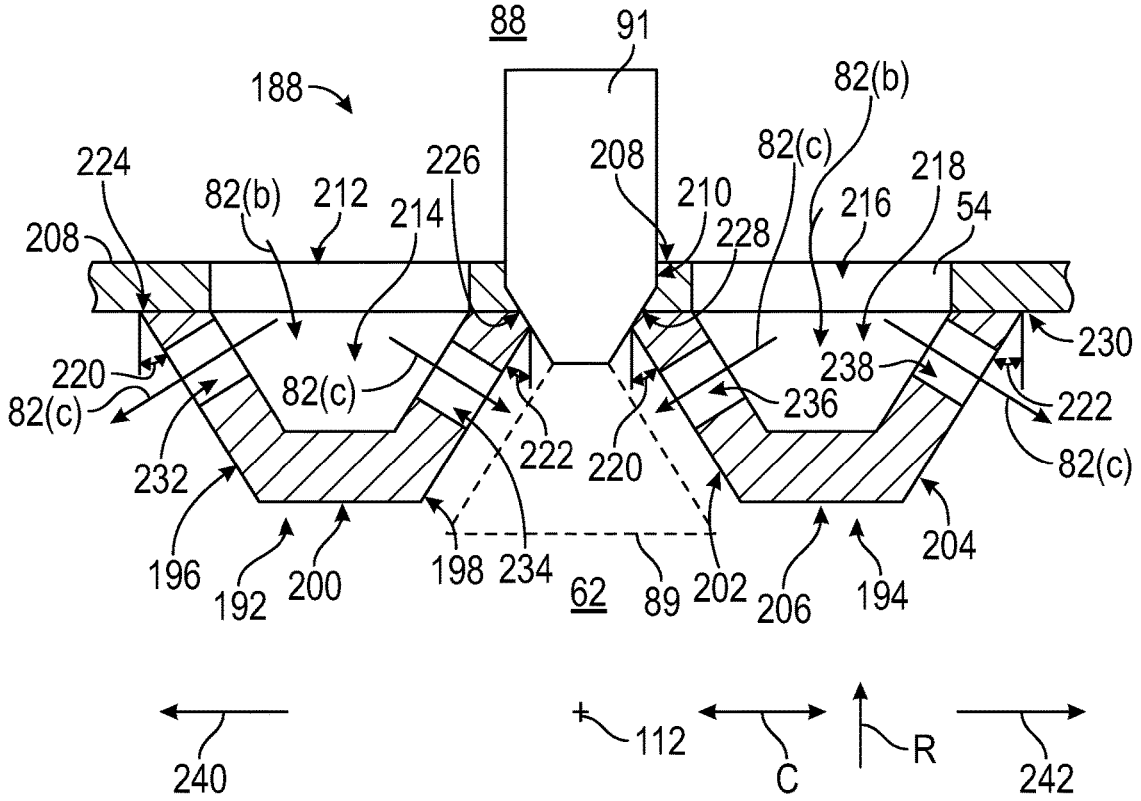
FIG. 7 is an aft forward-looking partial cross-sectional view of a portion of the outer liner dilution fence, taken at plane A-A of FIG. 6, according to an aspect of the present disclosure.

FIG. 7 is an aft forward-looking partial cross-sectional view of a portion of the outer liner dilution fence 188, taken at plane A-A of FIG. 6, according to an aspect of the present disclosure. In FIG. 7, the outer liner dilution fence 188 includes a plurality of outer liner dilution fence portions that are circumferentially spaced apart in a circumferential direction (C), including a first outer liner dilution fence portion 192 and a second outer liner dilution fence portion 194. The first outer liner dilution fence portion 192 includes a first lateral side portion 196 and a second lateral side portion 198 that are joined together by a trough portion 200. The first lateral side portion 196 may be arranged at a first angle 220 with respect to a radial direction (R) extending from the combustor centerline axis 112 to a radially outer end 224 of the first lateral side portion 196, and the second lateral side portion may be arranged at a second angle 222 with respect to a radial direction (R) extending from the combustor centerline axis 112 to a radially outer end 226 of the second lateral side portion 198. Similarly, the second outer liner dilution fence portion 194 includes a first lateral side portion 202 and a second lateral side portion 204 that are joined together by a trough portion 206. The first lateral side portion 202 may also extend at the first angle 220 with respect to a radial direction (R) extending from the combustor centerline axis 112 to a radially outer end 228 of the first lateral side portion 202, and the second lateral side portion 204 may extend at the second angle 222 with respect to a radial direction (R) extending from the combustor centerline axis 112 to a radially outer end 230 of the second lateral side portion 204.

The first outer liner dilution fence portion 192 and the second outer liner dilution fence portion 194 are joined together by a dilution fence crest portion 208, which may form part of the outer liner 54. In the FIG. 7 aspect, the dilution fence crest portion 208 includes a secondary fuel nozzle opening 210 therethrough, and the secondary fuel nozzle 91 is arranged in the secondary fuel nozzle opening 210. As with the FIG. 2 to FIG. 5 aspects, the outer liner dilution fence 188 may include a plurality of circumferentially spaced secondary fuel nozzle openings 210 that include a respective secondary fuel nozzle 91 extending therethrough. Similar to the FIGS. 2 to 5 aspects, the secondary fuel nozzle 91 may include any of a spray-type fuel nozzle, a jet-type fuel nozzle, and a pressure-swirl type fuel nozzle.

The first outer liner dilution fence portion 192 may include an outer liner dilution opening 212 through the outer liner 54 that allows a flow of the compressed air 82(*b*) from the outer flow passage 88 into a cavity 214 of the first outer liner dilution fence portion 192. Similarly, the second outer liner dilution fence portion 194 may include an outer liner dilution opening 216 that allows a flow of the compressed air 82(*b*) from the outer flow passage 88 into a cavity 218 of the second outer liner dilution fence portion 194. The first outer liner dilution fence portion 192 includes at least one first lateral side dilution opening 232 through the first lateral side portion 196, and includes at least one second lateral side dilution opening 234 through the second lateral side portion 198. Similarly, the second outer liner dilution fence portion 194 includes at least one first lateral side dilution opening 236 through the first lateral side portion 202 and at least one second lateral side dilution opening 238 through the second lateral side portion 204. The first lateral side dilution opening 232 of the first outer liner dilution fence portion 192 and the first lateral side dilution opening 236 of the second outer liner dilution fence portion 194 are arranged to provide a flow of the dilution air 82(*c*) therethrough in a first lateral direction 240. The second lateral side dilution opening 234 of the first outer liner dilution fence portion 192 and the second lateral side dilution opening 238 of the second outer liner dilution fence portion 194 are arranged to provide a flow of the dilution air 82(*c*) therethrough in a second lateral direction 242 different from the first lateral direction 240.

As can be seen in FIG. 7, the secondary fuel nozzle opening 210 is arranged between the second lateral side portion 198 of the first outer liner dilution fence portion 192 and the first lateral side portion 202 of the second outer liner dilution fence portion 194 such that the second lateral side dilution opening 234 of the first outer liner dilution fence portion 192 and the first lateral side dilution opening 236 of the second outer liner dilution fence portion 194 are arranged to provide a converging flow of dilution air 82(*c*) into the combustion chamber 62 against the secondary fuel 89 injected into the combustion chamber 62 by the secondary fuel nozzle 91. Additionally, the first lateral side dilution opening 232 of the first outer liner dilution fence portion 192 and the second lateral side dilution opening 238 of the second outer liner dilution fence portion 194 are arranged provide a diverging flow of the dilution air 82(*c*) into the combustion chamber 62. With the foregoing arrangement of FIG. 7, the dilution air 82(*c*) can be spread laterally within the combustion chamber 62 so as to provide lateral mixing of the dilution air 82(*c*) with the combustion gases 86. Additionally, the converging flow of the dilution air 82(*c*) against the secondary fuel 89 injected into the combustion chamber 62 by the secondary fuel nozzle 91 can achieve better penetration into the combustion chamber 62 and reduce the potential for fuel wetting of the outer liner dilution fence 188.

Figure 8:
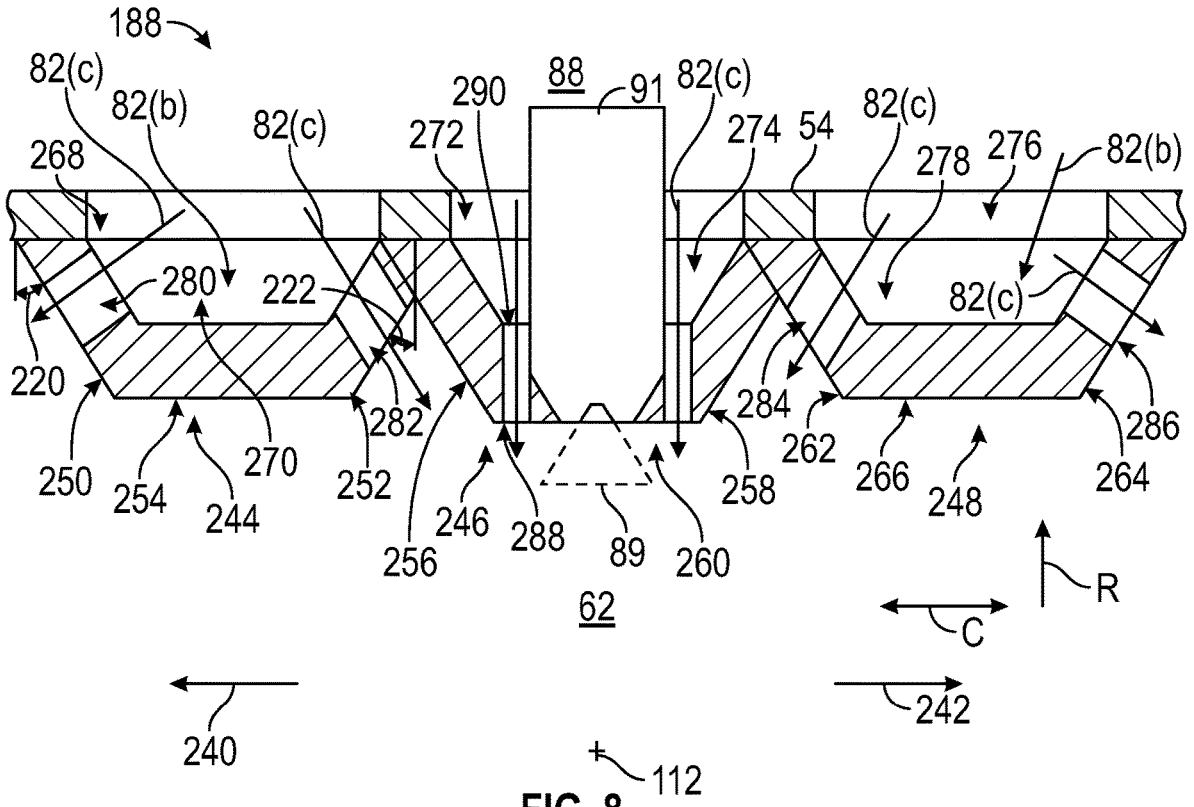
FIG. 8 is an aft forward-looking partial cross-sectional view of an alternate outer liner dilution fence, according to another aspect of the present disclosure.

FIG. 8 is an aft forward-looking partial cross-sectional view of a portion of the outer liner dilution fence 188, depicting an alternative arrangement according to another aspect of the present disclosure. In the FIG. 8 aspect, the outer liner dilution fence 188 includes a first outer liner dilution fence portion 244, a second outer liner dilution fence portion 246 circumferentially adjacent to the first outer liner dilution fence portion 244, and a third outer liner dilution fence portion 248 arranged circumferentially adjacent to the second outer liner dilution fence portion 246. The first outer liner dilution fence portion 244 may include a first lateral side portion 250, a second lateral side portion 252, and a trough portion 254 connecting the first lateral side portion 250 and the second lateral side portion 252. Similarly, the second outer liner dilution fence portion 246 may include a first lateral side portion 256, a second lateral side portion 258, and a trough portion 260 connecting the first lateral side portion 256 and the second lateral side portion 258, and the third outer liner dilution fence portion 248 may include a first lateral side portion 262, a second lateral side portion 264, and a trough portion 266 connecting the first lateral side portion 262 and the second lateral side portion 264. The first outer liner dilution fence portion 244 may include an outer liner dilution opening 268 through the outer liner 54 that allows a flow of the compressed air 82(*b*) from the outer flow passage 88 to flow into a cavity 270 of the first outer liner dilution fence portion 244. Similarly, the second outer liner dilution fence portion 246 may include an outer liner dilution opening 272 that allows a flow of the compressed air 82(*b*) from the outer flow passage 88 to flow into a cavity 274 of the second outer liner dilution fence portion 246. Also, similarly, the third outer liner dilution fence portion 248 may include an outer liner dilution opening 276 that allows a flow of the compressed air 82(*b*) from the outer flow passage 88 to flow into a cavity 278 of the third outer liner dilution fence portion 248.

Similar to the FIG. 7 aspect, the first outer liner dilution fence portion 244 includes at least one first lateral side dilution opening 280 through the first lateral side portion 250, and includes at least one second lateral side dilution opening 282 through the second lateral side portion 252, and the third outer liner dilution fence portion 248 includes at least one first lateral side dilution opening 284 through the first lateral side portion 262 and at least one second lateral side dilution opening 286 through the second lateral side portion 264. The first lateral side dilution opening 280 of the first outer liner dilution fence portion 244 and the first lateral side dilution opening 284 of the third outer liner dilution fence portion 248 are arranged to provide a flow of the dilution air 82(*c*) therethrough in the first lateral direction 240. The second lateral side dilution opening 282 of the first outer liner dilution fence portion 244 and the second lateral side dilution opening 286 of the third outer liner dilution fence portion 248 are arranged to provide a flow of the dilution air 82(*c*) therethrough in the second lateral direction 242 different from the first lateral direction 240.

A secondary fuel nozzle opening 288 is arranged through the trough portion 260 of the second outer liner dilution fence portion 246, and the secondary fuel nozzle 91 is arranged through the secondary fuel nozzle opening 288. In the FIG. 8 aspect, the secondary fuel nozzle opening 288 may include a secondary fuel nozzle swirler 290 that may swirl a flow of the dilution air 82(*c*) passing therethrough. Similar to the FIG. 7 aspect, the flow of dilution air 82(*c*) through the second lateral side dilution opening 282 of the first outer liner dilution fence portion 244, and the flow of the dilution air 82(*c*) through the first lateral side dilution opening 284 of the third outer liner dilution fence portion 248, provide a converging flow of the dilution air 82(*c*) into the combustion chamber 62 against the secondary fuel 89 injected into the combustion chamber by the secondary fuel nozzle 91. Additionally, the first lateral side dilution opening 280 of the first outer liner dilution fence portion 244 and the second lateral side dilution opening 286 of the third outer liner dilution fence portion 248 provide a diverging flow of the dilution air 82(*c*) into the combustion chamber 62.

Figure 9:
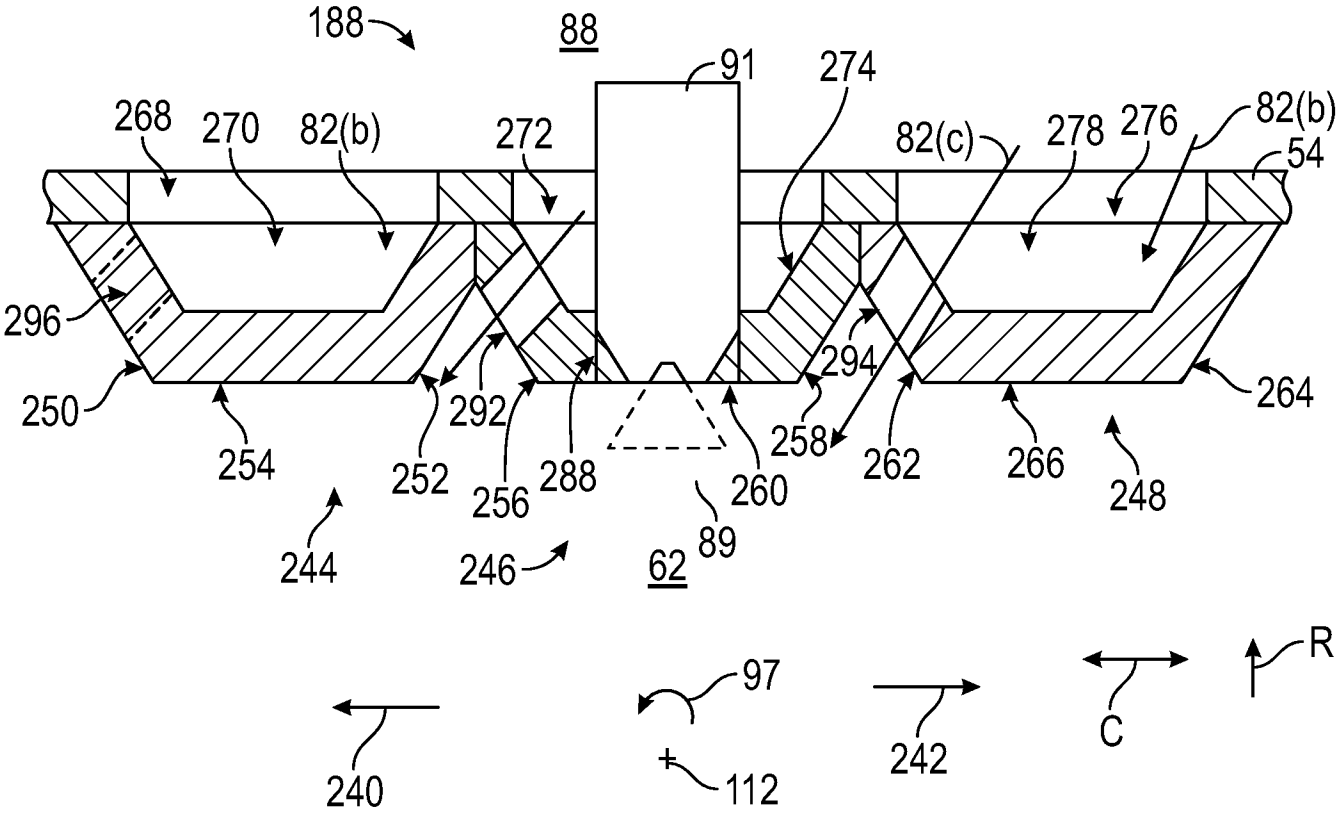
FIG. 9 is an aft forward-looking partial cross-sectional view of an alternate outer liner dilution fence, according to another aspect of the present disclosure.

FIG. 9 is an aft forward-looking partial cross-sectional view of a portion of the outer liner dilution fence 188, depicting another alternative arrangement, according to still another aspect of the present disclosure. The FIG. 9 aspect is similar to the FIG. 8 aspect in that the outer liner dilution fence 188 includes the first outer liner dilution fence portion 244, the second outer liner dilution fence portion 246 circumferentially adjacent to the first outer liner dilution fence portion 244, and the third outer liner dilution fence portion 248 arranged circumferentially adjacent to the second outer liner dilution fence portion 246. In addition, similar to the FIG. 8 aspect, the second outer liner dilution fence portion 246 includes the secondary fuel nozzle opening 288 through the trough portion 260, and the secondary fuel nozzle 91 is arranged through the secondary fuel nozzle opening 288. The arrangement of FIG. 9, however, provides a flow of the dilution air 82(*c*) into the combustion chamber 62 by each of the dilution fence portions in a same lateral direction. Thus, in the FIG. 9 aspect, the second outer liner dilution fence portion 246 includes a first lateral side dilution opening 292 through the first lateral side portion 256, and the third outer liner dilution fence portion 248 includes a first lateral side dilution opening 294 through the first lateral side portion 262. Both the first lateral side dilution opening 292 of the second outer liner dilution fence portion 246 and the first lateral side dilution opening 294 of the third outer liner dilution fence portion 248 are shown to be arranged to provide the flow of the dilution air 82(*c*) in the first lateral direction 240. In addition, the first outer liner dilution fence portion 244 may also include a first lateral side dilution opening 296 (shown with hidden lines). In some aspects, in which the main mixer swirl direction 97 is in a counterclockwise direction, as shown in FIG. 9, the first lateral direction 240 is the same direction as the main mixer swirl direction 97 so as to provide the flow of the dilution air 82(*c*) in a co-swirl direction with the main mixer swirl direction 97. Alternatively, when the main mixer swirl direction 97 is in a clockwise direction, the FIG. 9 aspect provides the flow of the dilution air 82(*c*) in a counter-swirl direction with respect to the main mixer swirl direction 97.

Figure 10:
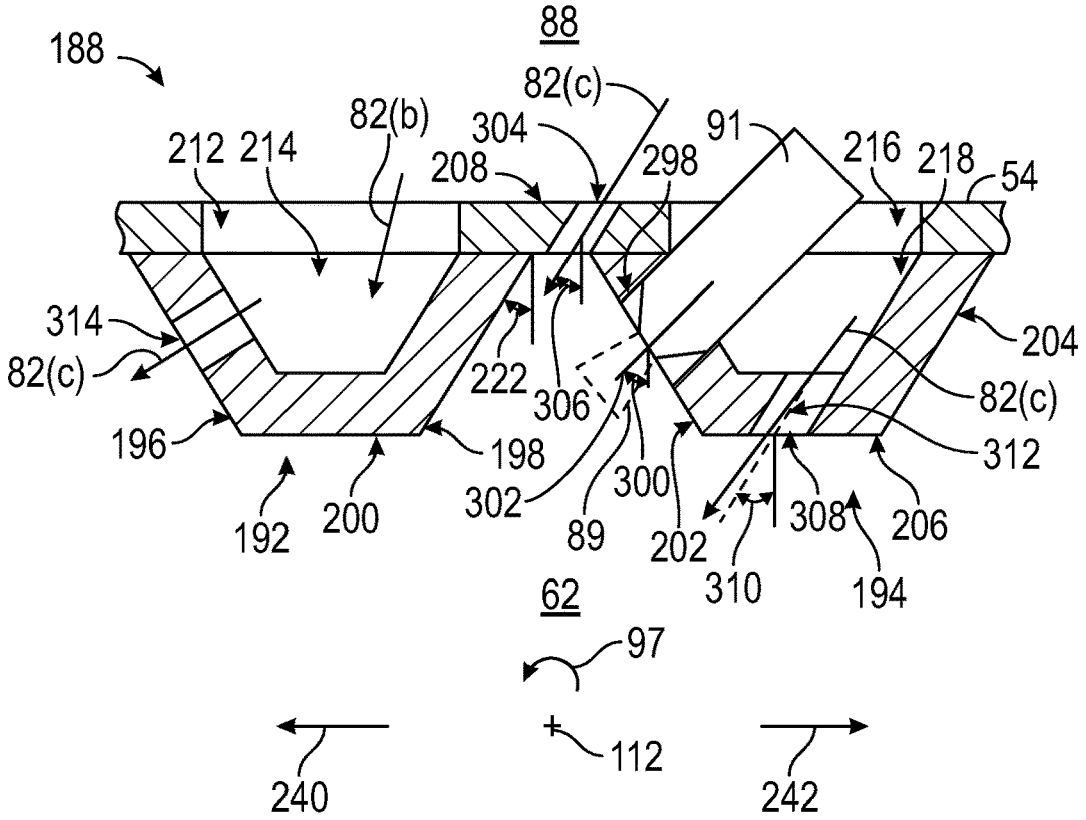
FIG. 10 is an aft forward-looking partial cross-sectional view of an alternate outer liner dilution fence, according to another aspect of the present disclosure.

FIG. 10 is an aft forward-looking partial cross-sectional view of an alternate arrangement of a portion of the outer liner dilution fence 188, according to yet another aspect of the present disclosure. The FIG. 10 aspect is somewhat similar to the FIG. 7 aspect in that it includes the first outer liner dilution fence portion 192 and the second outer liner dilution fence portion 194 that are connected together by the dilution fence crest portion 208. In the FIG. 10 aspect, however, a secondary fuel nozzle opening 298 is included in the first lateral side portion 202 of the second outer liner dilution fence portion 194. The secondary fuel nozzle opening 298 may be arranged at an angle 300 with respect to a radial direction (R) extending from the combustor centerline axis 112 to a centerline axis 302 of the secondary fuel nozzle opening 298. The secondary fuel nozzle 91 is arranged within the secondary fuel nozzle opening 298 and the secondary fuel 89 is thus injected into the combustion chamber 62 in the first lateral direction 240. To reduce the possibility of the secondary fuel 89 wetting the second lateral side portion 198 of the first outer liner dilution fence portion 192, a crest dilution opening 304 is provided through the dilution fence crest portion 208 at an angle 306, which may be the same as the second angle 222 of the second lateral side portion 198. The FIG. 10 aspect also includes a trough portion dilution opening 308 through the trough portion 206 of the second outer liner dilution fence portion 194, and the trough portion dilution opening 308 has a centerline axis 312 that is arranged at an angle 310, which may the same as the angle 306. Additionally, a first lateral side dilution opening 314, similar to the first lateral side dilution opening 232 of FIG. 7, may be provided through the first lateral side portion 196 of the first outer liner dilution fence portion 192. Thus, dilution air 82(*c*) is provided through the crest dilution opening 304 and through the trough portion dilution opening 308 in the first lateral direction 240, which may be a co-swirl direction with the main mixer swirl direction 97. In addition, the dilution air 82(*c*) being provided as shown in FIG. 10 can reduce the potential of the secondary fuel 89 wetting the second lateral side portion 198 of the first outer liner dilution fence portion 192.

Figure 11:
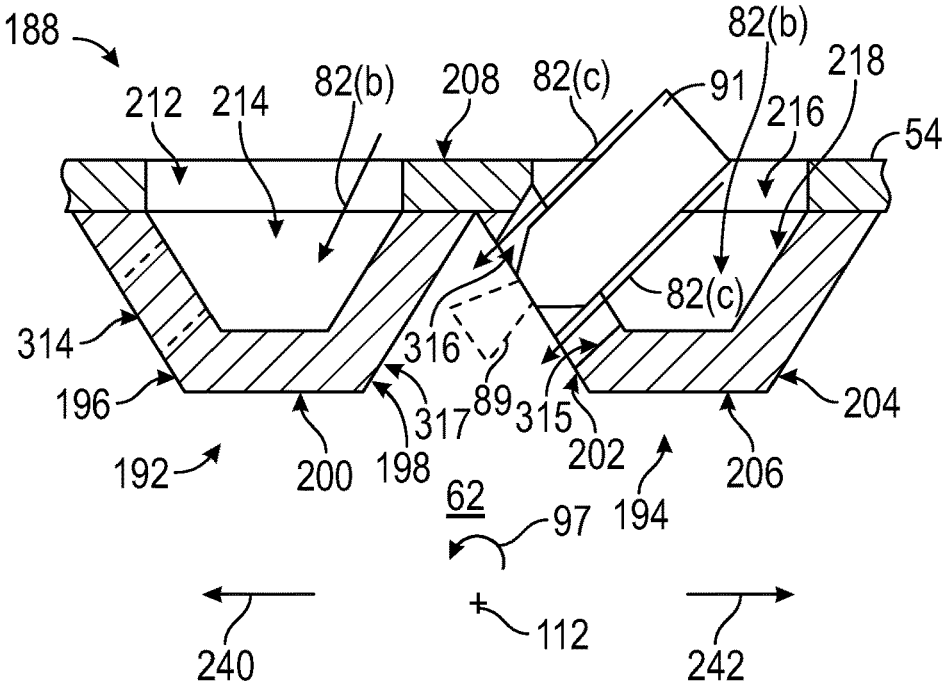
FIG. 11 is an aft forward-looking partial cross-sectional view of an alternate outer liner dilution fence, according to another aspect of the present disclosure.

FIG. 11 is an aft forward-looking partial cross-sectional view of an alternate arrangement of a portion of the outer liner dilution fence 188, according to yet another aspect of the present disclosure. The FIG. 11 aspect is similar to the FIG. 10 aspect. In FIG. 11, a secondary fuel nozzle opening 315 is provided through the first lateral side portion 202 of the second outer liner dilution fence portion 194. However, in contrast to the FIG. 10 aspect, the secondary fuel nozzle opening 315 may be larger than the secondary fuel nozzle 91 so as to provide a gap 316 between the secondary fuel nozzle opening 315 and the secondary fuel nozzle 91 to allow a flow of dilution air 82(*c*) to flow through the gap 316 around an outer periphery of the secondary fuel nozzle 91 and along a surface 317 of the second lateral side portion 198 of the first outer liner dilution fence portion 192. The flow of dilution air 82(*c*) through the gap 316 may assist in directing the flow of the secondary fuel 89 from the secondary fuel nozzle 91 away from the outer liner dilution fence 188 so as to reduce the possibility of the secondary fuel 89 wetting the second lateral side portion 198 of the first outer liner dilution fence portion 192.

While the foregoing description relates generally to a gas turbine engine, the gas turbine engine, however, may be implemented in various environments. For example, the engine may be implemented in an aircraft, but may also be implemented in non-aircraft applications such as power generating stations, marine applications, or oil and gas production applications. Thus, the present disclosure is not limited to use in aircraft.

Thus, each of the foregoing aspects of the present disclosure provide dilution air flow and staging of secondary fuel within the combustion chamber through a dilution fence. With the foregoing arrangements, secondary fuel can be staged at the dilution zone to mix with the dilution air and with the combustion gases to achieve better $NO_x$ emissions.

Further aspects of the present disclosure are provided by the subject matter of the following clauses.

A combustor for a gas turbine, the combustor including a combustor liner having an outer liner and an inner liner defining a combustion chamber therebetween, at least one of the outer liner and the inner liner including a dilution fence arranged in a dilution zone of the combustion chamber, the dilution fence extending into the combustion chamber and having at least one secondary fuel nozzle opening therethrough, at least one main mixer assembly arranged at an upstream end of the combustion chamber, and at least one secondary fuel nozzle arranged through the at least one secondary fuel nozzle opening of the dilution fence.

The combustor according to the preceding clause, wherein the at least one secondary fuel nozzle opening includes a gap that provides a flow of dilution air therethrough around the at least one secondary fuel nozzle.

The combustor according to any preceding clause, wherein the at least one secondary fuel nozzle opening includes a swirler arranged to provide a swirled flow of dilution air therethrough about the at least one secondary fuel nozzle.

The combustor according to any preceding clause, wherein the at least one secondary fuel nozzle is arranged to provide a flow of fuel into the combustion chamber in one of a first lateral direction, a second lateral direction, an upstream direction, and a downstream direction, and, one of the first lateral direction and the second lateral direction is a same direction as a swirl direction of the at least one main mixer assembly of the combustor.

The combustor according to any preceding clause, wherein the outer liner and the inner liner extend circumferentially about a combustor centerline axis, and the dilution fence extends circumferentially about the combustor centerline axis, and the dilution fence includes a dilution fence upstream portion and a dilution fence downstream portion.

The combustor according to any preceding clause, wherein the dilution fence is an outer liner dilution fence including an outer liner dilution fence upstream portion and an outer liner dilution fence downstream portion, and the at least one secondary fuel nozzle opening extends through the outer liner dilution fence upstream portion, and the outer liner further includes at least one outer liner dilution opening therethrough arranged downstream of the outer liner dilution fence downstream portion and arranged to provide a flow of dilution air along a downstream side of the outer liner dilution fence downstream portion.

The combustor according to any preceding clause, wherein the inner liner includes an inner liner dilution fence extending into the combustion chamber, the inner liner dilution fence including an inner liner dilution fence upstream portion having at least one inner liner dilution fence dilution opening therethrough, and an inner liner dilution fence downstream portion, and the inner liner including at least one inner liner dilution opening therethrough arranged downstream of the inner liner dilution fence downstream portion and arranged to provide a flow of dilution air along a downstream side of the inner liner dilution fence downstream portion.

The combustor according to any preceding clause, wherein the inner liner dilution fence and the outer liner dilution fence are offset from one another in a longitudinal direction along a combustion chamber centerline axis.

The combustor according to any preceding clause, wherein the dilution fence further includes at least one dilution opening therethrough, the at least one dilution opening extending through one of the dilution fence upstream portion and the dilution fence downstream portion, and the at least one secondary fuel nozzle opening extending through the other of the dilution fence upstream portion and the dilution fence downstream portion.

The combustor according to any preceding clause, wherein the dilution fence is an outer liner dilution fence, and the inner liner includes an inner liner dilution fence extending into the combustion chamber, the inner liner dilution fence including an inner liner dilution fence upstream portion having at least one inner liner dilution fence dilution opening therethrough, and an inner liner dilution fence downstream portion, and the inner liner including at least one inner liner dilution opening therethrough arranged downstream of the inner liner dilution fence downstream portion and arranged to provide a flow of dilution air along a downstream side of the inner liner dilution fence downstream portion.

The combustor according to any preceding clause, wherein the dilution fence is an outer liner dilution fence and includes a plurality of outer liner dilution fence portions that are circumferentially spaced apart in a circumferential direction, each of the plurality of outer liner dilution fence portions including a first lateral side portion and a second lateral side portion that are joined together by a trough portion.

The combustor according to any preceding clause, wherein the first lateral side portion is angled at a first angle with respect to the outer liner, and the second lateral side portion is angled at a second angle with respect to the outer liner, the first angle and the second angle converging with each other.

The combustor according to any preceding clause, wherein the outer liner dilution fence includes a first outer liner dilution fence portion and a second outer liner dilution fence portion among the plurality of outer liner dilution fence portions, the at least one secondary fuel nozzle opening being arranged through the first lateral side portion of the second outer liner dilution fence portion and being arranged to provide a dilution airflow therethrough around the at least one secondary fuel nozzle, and along an outer surface of the second lateral side portion of the first outer liner dilution fence portion.

The combustor according to any preceding clause, wherein the outer liner dilution fence includes a first outer liner dilution fence portion and a second outer liner dilution fence portion among the plurality of outer liner dilution fence portions, a dilution fence crest portion being arranged between the first outer liner dilution fence portion and the second outer liner dilution fence portion, the second outer liner dilution fence portion including a trough portion connecting the first lateral side portion and the second lateral side portion, the at least one secondary fuel nozzle opening being arranged through the first lateral side portion of the second outer liner dilution fence portion to provide a flow of fuel in a first lateral direction, the crest portion including a crest portion dilution opening therethrough arranged to provide a flow of dilution air in the first lateral direction, and the trough portion of the second outer liner dilution fence portion including a trough portion dilution opening therethrough arranged to provide a flow of dilution air therethrough in the first lateral direction.

The combustor according to any preceding clause, wherein each of the at least one secondary fuel nozzle opening is arranged through a dilution fence crest portion between a first outer liner dilution fence portion and a second outer liner dilution fence portion among the plurality of outer liner dilution fence portions.

The combustor according to any preceding clause, wherein the first outer liner dilution fence portion and the second outer liner dilution fence portion include at least one first lateral side dilution opening arranged to provide a flow of dilution air therethrough in a first lateral direction, and at least one second lateral side dilution opening arranged to provide a flow of dilution air therethrough in a second lateral direction different from the first lateral direction.

The combustor according to any preceding clause, wherein the at least one secondary fuel nozzle opening is arranged between the second lateral side portion of the first outer liner dilution fence portion and the first lateral side portion of the second outer liner dilution fence portion, the at least one second lateral side dilution opening of the first outer liner dilution fence portion and the at least one first lateral side dilution opening of the second outer liner dilution fence portion are arranged to provide a converging flow of dilution air into the combustion chamber, and the at least one first lateral side dilution opening of the first outer liner dilution fence portion and the at least one second lateral side dilution opening of the second outer liner dilution fence portion are arranged to provide a diverging flow of dilution air into the combustion chamber.

The combustor according to any preceding clause, wherein the outer liner dilution fence includes a first outer liner dilution fence portion, a second outer liner dilution fence portion circumferentially adjacent to the first outer liner dilution fence portion, and a third outer liner dilution fence portion arranged circumferentially adjacent to the second outer liner dilution fence portion.

The combustor according to any preceding clause, wherein the at least one secondary fuel nozzle opening is arranged through the second outer liner dilution fence portion, the first outer liner dilution fence portion and the third outer liner dilution fence portion include at least one first lateral side dilution opening arranged to provide a flow of dilution air therethrough in a first lateral direction, and at least one second lateral side dilution opening arranged to provide a flow of dilution air therethrough in a second lateral direction different from the first lateral direction, and the at least one second lateral side dilution opening of the first outer liner dilution fence portion and the at least one first lateral side dilution opening of the third outer liner dilution fence portion are arranged to provide a converging flow of dilution air into the combustion chamber, and the at least one first lateral side dilution opening of the first outer liner dilution fence portion and the at least one second lateral side dilution opening of the third outer liner dilution fence portion are arranged to provide a diverging flow of dilution air into the combustion chamber.

The combustor according to any preceding clause, wherein the at least one secondary fuel nozzle opening is arranged through the second outer liner dilution fence portion, and the second outer liner dilution fence portion and the third outer liner dilution fence portion include a lateral dilution opening through the first lateral side portion arranged to provide a flow of dilution air therethrough in a same lateral direction.

A gas turbine, including a compressor section, and a combustor receiving a flow of compressed air from the compressor section, the combustor including a combustor liner having an outer liner and an inner liner defining a combustion chamber therebetween, at least one of the outer liner and the inner liner including a dilution fence arranged in a dilution zone of the combustion chamber, the dilution fence extending into the combustion chamber and having at least one secondary fuel nozzle opening therethrough and having at least one dilution opening therethrough, a dome assembly arranged at an upstream end of the combustion chamber and extending between the outer liner and the inner liner, at least one main mixer assembly arranged through the dome assembly, the at least one main mixer assembly including a fuel nozzle assembly coupled thereto, a first portion of the compressed air received by the combustor from the compressor section being provided to the at least one main mixer assembly, an outer casing surrounding the outer liner and an inner casing surrounding the inner liner, an outer flow passage being defined between the outer casing and the outer liner, and an inner flow passage being defined between the inner casing and the inner liner, a second portion of the compressed air received by the combustor being provided to the outer flow passage and being provided to the inner flow passage, and at least one secondary fuel nozzle arranged through the at least one secondary fuel nozzle opening of the dilution fence, the at least one secondary fuel nozzle providing a flow of fuel to the combustion chamber in the dilution zone, and a flow of dilution air being provided to the combustion chamber through at least one of the secondary fuel nozzle opening and the dilution opening through the dilution fence.

The gas turbine according to the preceding clause, wherein the dilution fence includes a dilution fence upstream portion and a dilution fence downstream portion, and the at least one secondary fuel nozzle opening extends through one of the dilution fence upstream portion and the dilution fence downstream portion, and the dilution fence further includes at least one dilution opening therethrough arranged the other of the dilution fence upstream portion and the dilution fence downstream portion.

The gas turbine according to any preceding clause, wherein the dilution fence includes a plurality of dilution fence portions that are circumferentially spaced apart in a circumferential direction, each of the plurality of dilution fence portions including a first lateral side portion and a second lateral side portion that are joined together by a trough portion, and wherein the at least one secondary fuel nozzle opening is arranged through one of the first lateral side portion, the second lateral side portion, and the secondary fuel nozzle provides the flow of fuel in one of a first lateral direction and a second lateral direction.

The gas turbine according to the preceding clause, wherein the at least one secondary fuel nozzle opening includes a gap that provides a flow of dilution air therethrough around the at least one secondary fuel nozzle.

The gas turbine according to any preceding clause, wherein the at least one secondary fuel nozzle opening includes a swirler arranged to provide a swirled flow of dilution air therethrough about the at least one secondary fuel nozzle.

The gas turbine according to any preceding clause, wherein the at least one secondary fuel nozzle is arranged to provide a flow of fuel into the combustion chamber in one of a first lateral direction, a second lateral direction, an upstream direction, and a downstream direction, and, one of the first lateral direction and the second lateral direction is a same direction as a swirl direction of the at least one main mixer assembly of the combustor.

The gas turbine according to any preceding clause, wherein the outer liner and the inner liner extend circumferentially about a combustor centerline axis, and the dilution fence extends circumferentially about the combustor centerline axis, and the dilution fence includes a dilution fence upstream portion and a dilution fence downstream portion.

The gas turbine according to any preceding clause, wherein the dilution fence is an outer liner dilution fence including an outer liner dilution fence upstream portion and an outer liner dilution fence downstream portion, and the at least one secondary fuel nozzle opening extends through the outer liner dilution fence upstream portion, and the outer liner further includes at least one outer liner dilution opening therethrough arranged downstream of the outer liner dilution fence downstream portion and arranged to provide a flow of dilution air along a downstream side of the outer liner dilution fence downstream portion.

The gas turbine according to any preceding clause, wherein the inner liner includes an inner liner dilution fence extending into the combustion chamber, the inner liner dilution fence including an inner liner dilution fence upstream portion having at least one inner liner dilution fence dilution opening therethrough, and an inner liner dilution fence downstream portion, and the inner liner including at least one inner liner dilution opening therethrough arranged downstream of the inner liner dilution fence downstream portion and arranged to provide a flow of dilution air along a downstream side of the inner liner dilution fence downstream portion.

The gas turbine according to any preceding clause, wherein the inner liner dilution fence and the outer liner dilution fence are offset from one another in a longitudinal direction along a combustion chamber centerline axis.

The gas turbine according to any preceding clause, wherein the dilution fence further includes at least one dilution opening therethrough, the at least one dilution opening extending through one of the dilution fence upstream portion and the dilution fence downstream portion, and the at least one secondary fuel nozzle opening extending through the other of the dilution fence upstream portion and the dilution fence downstream portion.

The gas turbine according to any preceding clause, wherein the dilution fence is an outer liner dilution fence, and the inner liner includes an inner liner dilution fence extending into the combustion chamber, the inner liner dilution fence including an inner liner dilution fence upstream portion having at least one inner liner dilution fence dilution opening therethrough, and an inner liner dilution fence downstream portion, and the inner liner including at least one inner liner dilution opening therethrough arranged downstream of the inner liner dilution fence downstream portion and arranged to provide a flow of dilution air along a downstream side of the inner liner dilution fence downstream portion.

The gas turbine according to any preceding clause, wherein the dilution fence is an outer liner dilution fence and includes a plurality of outer liner dilution fence portions that are circumferentially spaced apart in a circumferential direction, each of the plurality of outer liner dilution fence portions including a first lateral side portion and a second lateral side portion that are joined together by a trough portion.

The gas turbine according to any preceding clause, wherein the first lateral side portion is angled at a first angle with respect to the outer liner, and the second lateral side portion is angled at a second angle with respect to the outer liner, the first angle and the second angle converging with each other.

The gas turbine according to any preceding clause, wherein the outer liner dilution fence includes a first outer liner dilution fence portion and a second outer liner dilution fence portion among the plurality of outer liner dilution fence portions, the at least one secondary fuel nozzle opening being arranged through the first lateral side portion of the second outer liner dilution fence portion and being arranged to provide a dilution airflow therethrough around the at least one secondary fuel nozzle, and along an outer surface of the second lateral side portion of the first outer liner dilution fence portion.

The gas turbine according to any preceding clause, wherein the outer liner dilution fence includes a first outer liner dilution fence portion and a second outer liner dilution fence portion among the plurality of outer liner dilution fence portions, a dilution fence crest portion being arranged between the first outer liner dilution fence portion and the second outer liner dilution fence portion, the second outer liner dilution fence portion including a trough portion connecting the first lateral side portion and the second lateral side portion, the at least one secondary fuel nozzle opening being arranged through the first lateral side portion of the second outer liner dilution fence portion to provide a flow of fuel in a first lateral direction, the crest portion including a crest portion dilution opening therethrough arranged to provide a flow of dilution air in the first lateral direction, and the trough portion of the second outer liner dilution fence portion including a trough portion dilution opening therethrough arranged to provide a flow of dilution air therethrough in the first lateral direction.

The gas turbine according to any preceding clause, wherein each of the at least one secondary fuel nozzle opening is arranged through a dilution fence crest portion between a first outer liner dilution fence portion and a second outer liner dilution fence portion among the plurality of outer liner dilution fence portions.

The gas turbine according to any preceding clause, wherein the first outer liner dilution fence portion and the second outer liner dilution fence portion include at least one first lateral side dilution opening arranged to provide a flow of dilution air therethrough in a first lateral direction, and at least one second lateral side dilution opening arranged to provide a flow of dilution air therethrough in a second lateral direction different from the first lateral direction.

The gas turbine according to any preceding clause, wherein the at least one secondary fuel nozzle opening is arranged between the second lateral side portion of the first outer liner dilution fence portion and the first lateral side portion of the second outer liner dilution fence portion, the at least one second lateral side dilution opening of the first outer liner dilution fence portion and the at least one first lateral side dilution opening of the second outer liner dilution fence portion are arranged to provide a converging flow of dilution air into the combustion chamber, and the at least one first lateral side dilution opening of the first outer liner dilution fence portion and the at least one second lateral side dilution opening of the second outer liner dilution fence portion are arranged to provide a diverging flow of dilution air into the combustion chamber.

The gas turbine according to any preceding clause, wherein the outer liner dilution fence includes a first outer liner dilution fence portion, a second outer liner dilution fence portion circumferentially adjacent to the first outer liner dilution fence portion, and a third outer liner dilution fence portion arranged circumferentially adjacent to the second outer liner dilution fence portion.

The gas turbine according to any preceding clause, wherein the at least one secondary fuel nozzle opening is arranged through the second outer liner dilution fence portion, the first outer liner dilution fence portion and the third outer liner dilution fence portion include at least one first lateral side dilution opening arranged to provide a flow of dilution air therethrough in a first lateral direction, and at least one second lateral side dilution opening arranged to provide a flow of dilution air therethrough in a second lateral direction different from the first lateral direction, and the at least one second lateral side dilution opening of the first outer liner dilution fence portion and the at least one first lateral side dilution opening of the third outer liner dilution fence portion are arranged to provide a converging flow of dilution air into the combustion chamber, and the at least one first lateral side dilution opening of the first outer liner dilution fence portion and the at least one second lateral side dilution opening of the third outer liner dilution fence portion are arranged to provide a diverging flow of dilution air into the combustion chamber.

The gas turbine according to any preceding clause, wherein the at least one secondary fuel nozzle opening is arranged through the second outer liner dilution fence portion, and the second outer liner dilution fence portion and the third outer liner dilution fence portion include a lateral dilution opening through the first lateral side portion arranged to provide a flow of dilution air therethrough in a same lateral direction.

Although the foregoing description is directed to some exemplary embodiments of the present disclosure, other variations and modifications will be apparent to those skilled in the art, and may be made without departing from the spirit or the scope of the disclosure. Moreover, features described in connection with one embodiment of the present disclosure may be used in conjunction with other embodiments, even if not explicitly stated above.

We claim:

1. A combustor for a gas turbine, the combustor comprising:

at least one main mixer assembly receiving compressed air and a first flow of fuel from a primary fuel nozzle, and mixing the compressed air and the first flow of fuel to generate a fuel and air mixture;

a combustor liner having an outer liner and an inner liner defining a combustion chamber therebetween, the combustion chamber arranged downstream of the at least one main mixer assembly and having a primary combustion zone and a dilution zone, at least one of the outer liner or the inner liner including (a) a hot surface side, (b) a slotted dilution opening extending circumferentially about a combustor centerline axis and (c) a dilution fence arranged in the dilution zone of the combustion chamber, the dilution fence spanning across the slotted dilution opening, extending into the combustion chamber, and having at least one secondary fuel nozzle opening therethrough;

at least one secondary fuel nozzle arranged through the at least one secondary fuel nozzle opening of the dilution fence, the secondary fuel nozzle providing a second flow of fuel, the second flow of fuel passing through the slotted dilution opening and through the secondary fuel nozzle to the combustion chamber in the dilution zone;

an outer casing surrounding the outer liner;

an outer flow passage defined between the outer casing and the outer liner;

an inner casing radially inward of the inner liner; and an inner flow passage defined between the inner casing and the inner liner, wherein the slotted dilution opening is open to the outer flow passage or the inner flow passage, wherein the primary combustion zone receives the fuel and air mixture from the at least one main mixer assembly, the fuel and air mixture combusts in the primary combustion zone to produce combustion gases, and the combustion gases flow into the dilution zone to mix with the second flow of fuel, wherein the dilution fence has a dilution fence upstream portion and a dilution fence downstream portion, the dilution fence upstream portion and the dilution fence downstream portion each having a distal end at the hot surface side and extending into the combustion chamber from the hot surface side.

2. The combustor according to claim 1, wherein the at least one secondary fuel nozzle opening includes a gap that provides a flow of dilution air therethrough around the at least one secondary fuel nozzle.

3. The combustor according to claim 1, wherein the at least one secondary fuel nozzle is arranged to provide a flow of fuel into the combustion chamber in one of a first lateral direction, a second lateral direction, an upstream direction, and a downstream direction, and, one of the first lateral direction and the second lateral direction is a same direction as a swirl direction of the at least one main mixer assembly of the combustor.

4. The combustor according to claim 1, wherein the outer liner and the inner liner extend circumferentially about the combustor centerline axis, and the dilution fence extends circumferentially about the combustor centerline axis, and the dilution fence upstream portion extends into the combustion chamber at a downstream angle, and the dilution fence downstream portion extends into the combustion chamber at an upstream angle, the dilution fence upstream portion and the dilution fence downstream portion being joined together at an inner end of the dilution fence.

5. The combustor according to claim 4, wherein the dilution fence is an outer liner dilution fence, the dilution fence upstream portion is an outer liner dilution fence upstream portion, the dilution fence downstream portion is an outer liner dilution fence downstream portion, and the at least one secondary fuel nozzle opening extends through the outer liner dilution fence upstream portion, and the outer liner further includes at least one outer liner dilution opening therethrough arranged downstream of the outer liner dilution fence downstream portion and arranged to provide a flow of dilution air along a downstream side of the outer liner dilution fence downstream portion.

6. The combustor according to claim 5, wherein the inner liner includes an inner liner dilution fence extending into the combustion chamber, the inner liner dilution fence including an inner liner dilution fence upstream portion having at least one inner liner dilution fence dilution opening therethrough, and an inner liner dilution fence downstream portion, and the inner liner including at least one inner liner dilution opening therethrough arranged downstream of the inner liner dilution fence downstream portion and arranged to provide a flow of dilution air along a downstream side of the inner liner dilution fence downstream portion.

7. The combustor according to claim 4, wherein the dilution fence further includes at least one dilution opening therethrough, the at least one dilution opening extending through one of the dilution fence upstream portion or the dilution fence downstream portion, and the at least one secondary fuel nozzle opening extending through another of the dilution fence upstream portion or the dilution fence downstream portion.

8. The combustor according to claim 1, wherein the dilution fence is an outer liner dilution fence and includes a plurality of outer liner dilution fence portions that are circumferentially spaced apart in a circumferential direction, each of the plurality of outer liner dilution fence portions including a first lateral side portion and a second lateral side portion that are joined together by a trough portion.

9. The combustor according to claim 8, wherein the first lateral side portion is angled at a first angle with respect to the outer liner, and the second lateral side portion is angled at a second angle with respect to the outer liner, the first angle and the second angle converging with each other.

10. The combustor according to claim 8, wherein the outer liner dilution fence includes a first outer liner dilution fence portion and a second outer liner dilution fence portion among the plurality of outer liner dilution fence portions, the at least one secondary fuel nozzle opening being arranged through the first lateral side portion of the second outer liner dilution fence portion and being arranged to provide a dilution airflow therethrough around the at least one secondary fuel nozzle, and along an outer surface of the second lateral side portion of the first outer liner dilution fence portion.

11. The combustor according to claim 8, wherein the outer liner dilution fence includes a first outer liner dilution fence portion and a second outer liner dilution fence portion among the plurality of outer liner dilution fence portions, a dilution fence crest portion being arranged between the first outer liner dilution fence portion and the second outer liner dilution fence portion, the second outer liner dilution fence portion including a trough portion connecting the first lateral side portion and the second lateral side portion, the at least one secondary fuel nozzle opening being arranged through the first lateral side portion of the second outer liner dilution fence portion to provide a flow of fuel in a first lateral direction, the dilution fence crest portion including a crest portion dilution opening therethrough arranged to provide a flow of dilution air through the dilution fence crest portion in the first lateral direction, and the trough portion of the second outer liner dilution fence portion including a trough portion dilution opening therethrough arranged to provide a flow of dilution air through the trough portion in the first lateral direction.

12. The combustor according to claim 8, wherein each of the at least one secondary fuel nozzle opening is arranged through a dilution fence crest portion between a first outer liner dilution fence portion and a second outer liner dilution fence portion among the plurality of outer liner dilution fence portions.

13. The combustor according to claim 12, wherein the first outer liner dilution fence portion and the second outer liner dilution fence portion include at least one first lateral side dilution opening arranged to provide a flow of dilution air through the first lateral side in a first lateral direction, and at least one second lateral side dilution opening arranged to provide a flow of dilution air through the second lateral side in a second lateral direction different from the first lateral direction.

14. The combustor according to claim 13, wherein the at least one secondary fuel nozzle opening is arranged between the second lateral side portion of the first outer liner dilution fence portion and the first lateral side portion of the second outer liner dilution fence portion, the at least one second lateral side dilution opening of the first outer liner dilution fence portion and the at least one first lateral side dilution opening of the second outer liner dilution fence portion are arranged to provide a converging flow of dilution air into the combustion chamber, and the at least one first lateral side dilution opening of the first outer liner dilution fence portion and the at least one second lateral side dilution opening of the second outer liner dilution fence portion are arranged to provide a diverging flow of dilution air into the combustion chamber.

15. The combustor according to claim 8, wherein the outer liner dilution fence includes a first outer liner dilution fence portion, a second outer liner dilution fence portion circumferentially adjacent to the first outer liner dilution fence portion, and a third outer liner dilution fence portion arranged circumferentially adjacent to the second outer liner dilution fence portion.

16. The combustor according to claim 15, wherein the at least one secondary fuel nozzle opening is arranged through the second outer liner dilution fence portion, the first outer liner dilution fence portion and the third outer liner dilution fence portion include at least one first lateral side dilution opening arranged to provide a flow of dilution air through the first lateral side in a first lateral direction, and at least one second lateral side dilution opening arranged to provide a flow of dilution air through the second lateral side in a second lateral direction different from the first lateral direction, and the at least one second lateral side dilution opening of the first outer liner dilution fence portion and the at least one first lateral side dilution opening of the third outer liner dilution fence portion are arranged to provide a converging flow of dilution air into the combustion chamber, and the at least one first lateral side dilution opening of the first outer liner dilution fence portion and the at least one second lateral side dilution opening of the third outer liner dilution fence portion are arranged to provide a diverging flow of dilution air into the combustion chamber.

17. The combustor according to claim 15, wherein the at least one secondary fuel nozzle opening is arranged through the second outer liner dilution fence portion, and the second outer liner dilution fence portion and the third outer liner dilution fence portion include a lateral dilution opening through the first lateral side portion arranged to provide a flow of dilution air therethrough in a same lateral direction.

18. A gas turbine comprising:

a compressor section; and a combustor receiving a flow of compressed air from the compressor section, the combustor including:

a dome assembly;

at least one main mixer assembly arranged through the dome assembly receiving a first portion of compressed air from the compressor section and a first flow of fuel from a primary fuel nozzle, and mixing the first portion of compressed air and the first flow of fuel to generate a fuel and air mixture;

a combustor liner having an outer liner and an inner liner extending around the dome assembly and defining a combustion chamber therebetween, the combustion chamber arranged downstream of the at least one main mixer assembly and having a primary combustion zone and a dilution zone, at least one of the outer liner or the inner liner including (a) a hot surface side, (b) a slotted dilution opening extending circumferentially about a combustor centerline axis and (c) a dilution fence arranged in the dilution zone of the combustion chamber, the dilution fence spanning across the slotted dilution opening, extending into the combustion chamber, having at least one secondary fuel nozzle opening therethrough, and having at least one dilution opening therethrough;

an outer casing surrounding the outer liner and an inner casing radially inward of the inner liner, an outer flow passage being defined between the outer casing and the outer liner, and an inner flow passage being defined between the inner casing and the inner liner, a second portion of the compressed air received from the compressor section being provided to the outer flow passage and being provided to the inner flow passage; and at least one secondary fuel nozzle arranged through the at least one secondary fuel nozzle opening of the dilution fence, the at least one secondary fuel nozzle providing a second flow of fuel, the second flow of fuel passing through the slotted dilution opening and through the at least one secondary fuel nozzle to the combustion chamber in the dilution zone, and a flow of dilution air being provided to the combustion chamber through at least one of the secondary fuel nozzle opening or the at least one dilution opening through the dilution fence, wherein the slotted dilution opening is open to the outer flow passage or the inner flow passage, wherein the primary combustion zone receives the fuel and air mixture from the at least one main mixer assembly, the fuel and air mixture combusts in the primary combustion zone to produce combustion gases, the combustion gases flow into the dilution zone to mix with the second flow of fuel, wherein the dilution fence comprises a dilution fence upstream portion extending into the combustion chamber at a downstream angle, and a dilution fence downstream portion extending into the combustion chamber at an upstream angle, the dilution fence upstream portion and the dilution fence downstream portion being joined together at an inner end of the dilution fence, and wherein the dilution fence upstream portion and the dilution fence downstream portion each have a distal end at the hot surface side and extend into the combustion chamber from the hot surface side.

19. The gas turbine according to claim 18, wherein the at least one secondary fuel nozzle opening extends through one of the dilution fence upstream portion or the dilution fence downstream portion, and the dilution fence further includes the at least one dilution opening therethrough arranged through another of the dilution fence upstream portion or the dilution fence downstream portion.

20. The gas turbine according to claim 18, wherein the dilution fence includes a plurality of dilution fence portions that are circumferentially spaced apart in a circumferential direction, each of the plurality of dilution fence portions including a first lateral side portion and a second lateral side portion that are joined together by a trough portion, and wherein the at least one secondary fuel nozzle opening is arranged through one of the first lateral side portion, the second lateral side portion, and the secondary fuel nozzle provides the flow of fuel in one of a first lateral direction and a second lateral direction.

* * * * *